US006820568B1

(12) United States Patent
Shattock

(10) Patent No.: US 6,820,568 B1
(45) Date of Patent: Nov. 23, 2004

(54) HYDROFOIL APPARATUS

(76) Inventor: Bernard Aubrey Shattock, 1 South Road, Felpham, Bognor Regis, West Sussex PO22 8EF (GB)

( * ) Notice: Subject to any disclaimer, the term of this patent is extended or adjusted under 35 U.S.C. 154(b) by 96 days.

(21) Appl. No.: 10/018,447

(22) PCT Filed: Jun. 5, 2000

(86) PCT No.: PCT/GB00/02169

§ 371 (c)(1),
(2), (4) Date: Dec. 13, 2001

(87) PCT Pub. No.: WO00/76839

PCT Pub. Date: Dec. 21, 2000

(51) Int. Cl.[7] ..... B63B 21/66
(52) U.S. Cl. ..... 114/244
(58) Field of Search ..... 114/244, 245, 114/253, 39.28, 39.24; 43/43.13

(56) References Cited

U.S. PATENT DOCUMENTS 2,980,052 A 4/1961 Fehlner
4,798,157 A * 1/1989 Duret ..... 114/253
5,896,825 A * 4/1999 Trefethen ..... 114/39.28

FOREIGN PATENT DOCUMENTS

FR 2758526 7/1998

* cited by examiner

*Primary Examiner*—Ed Swinehart
(74) *Attorney, Agent, or Firm*—Iandiorio & Teska

(57) ABSTRACT

Hydrofoil apparatus comprising a first hydrofoil member (1) having chord and span dimensions and positive hydrodynamic pitching moments, a second hydrofoil member (2) having chord and span dimensions and positive hydrodynamic pitching moments, connection means (3) for connecting the first and second hydrofoil members (1, 2) together such that they are able to articulate about the connection means (3), at least first and second bridle members (4, 6) which are for enabling the hydrofoil apparatus to be towed and are such that the first bridle member (4) is articulately attached at one end (5) to an outer end portion of the first hydrofoil member (1) thereby forming a first pitching axis (BC), the second bridle member (6) is articulately attached at one end (7) to an outer end portion of the second hydrofoil member (2) thereby forming a second pitching axis (DE), the first and second pitching axes (BC, DE) forming an angle such that a component of hydrodynamic lift generated by the first hydrofoil member (1) and a component of hydrodynamic lift generated by the second hydrofoil member (2) act in parallel directions away from each other, and regulation means (8, 11) by which the angle formed by the first and second pitching axes is regulated.

22 Claims, 15 Drawing Sheets

HYDROFOIL APPARATUS

FIELD OF THE INVENTION

This invention relates to hydrofoil apparatus and, more specifically, this invention relates to hydrofoil apparatus for inclusion in any towed arrangement which, in order to fulfill its function, requires hydrodynamic lift as a component of the force that opposes the towing effort.

BACKGROUND OF THE INVENTION

Known hydrofoil apparatus for towing fall generally into two use categories, but may also fall into both at once. The first category of use includes a wide variety of activities that require an object, or different types of equipment, to be towed through the water by a vessel or other towing point for purposes of, for example, performing special measurements, catching or positioning something. It is often important that the object or equipment being towed should not follow directly behind the point of tow but be pulled out by a diverter to one side or another, pulled downwards by a depressor, or even pulled upwards by an elevator, if the towing point is beneath the water surface. Examples of hydrofoil apparatus that can perform some of these roles have been variously referred to as paravanes; vanes; monowings; diverters; doors; otter boards or just otters; deflectors; depressors; elevators and kites.

The second category of use includes all those arrangements in which the effort generated by the hydrofoil apparatus is used to effect the towing point or vessel in some desirable way. These might, for example, include the role of a sea-anchor, when used to give some direction to a vessel's drift; the role of a stabilizer used to stabilize a vessel in roll; the role of providing lateral resistance in a sailing arrangement such as that of the more conventional waterborne vessel that supports a rig of sails, or a more unusual airborne arrangement of aerofoil such as, for example; an autogyro; a hang-glider, kite or other winged craft; a paraglider; or a displacement vessel such as an airship or balloon.

A water-air interface is an extremely complex and difficult environment in which to operate towed hydrofoil apparatus. Typically, on reaching or breaking the water surface, most hydrofoil apparatus for towing will become unstable and cease to function as desired.

For those bodies and types of equipment that are required to be towed at or close to the water surface, a common practice has been to ensure that the hydrofoil apparatus remains fully immersed and at the desired running depth by means of a float on the surface. However, this does little to stabilize the hydrofoil apparatus in yaw and can itself be disruptive in rough water, so additional means are usually employed. Where towed equipment produces enough drag force, this can be used to stabilize the hydrofoil apparatus in yaw, but it is not usually desirable to introduce a constant drag force unnecessarily. Also, the capacity of a float to exercise control remains fixed, while the disruptive dynamic forces over which it is required to prevail grow in proportion to the square of the water speed. The size of float required, as speeds increase, would therefore grow out of all proportion producing excessive drag and becoming potentially unmanageable and dangerous to handle. Furthermore, the use of a float does not avoid the inevitability that the hydrofoil surfaces will become partially unwetted during their launch and recovery; a condition that is usually unstable and can produce difficult if not dangerous handling.

Many bodies and other types of equipment are not required to be towed at or close to the water surfaces when fully deployed, so would be hampered by a float. Nevertheless, they too must usually pass through the surface conditions during their launch and recovery, and in many cases it is also desirable that this can be carried out at some speed and through rough water.

For sailing it is desirable that a hydrofoil apparatus is towed at the water surface and often at considerable speed through rough water. It is also desirable that the same apparatus may be operated on either tack, which can be difficult to arrange if a float is employed for surface sensing.

To assist or take over the functions of a float completely, known hydrofoil apparatus have therefore been constructed with anhedral, to sense the water surface in a simple dynamic way. These known apparatus have a lower portion of hydrofoil surface which is orientated to give a depressing component of lift and an upper portion orientated to give an elevating component of lift. These two lift components therefore act in parallel and opposite directions away from each other. The apparatus can then be adjusted in roll through bridle adjustments, until the elevating and depressing lift components are in balanced opposition, while a part of its elevating portion pierces the water surface to remain in reserve. Should there then be a gain or loss in wetted surface area, the resultant of the lift components provides a restoring force that works to restore the apparatus to the desired running depth.

Unfortunately though, the opposing lift components also tend to form couples that seek to turn the apparatus in the direction in which it is moving at any one moment, during its surface sensing depth corrections. If, therefore, the apparatus is responding to either an elevating or depressing lift resultant, it tends to turn upward, or downwards, respectively, towards the water surface. Further to this, the elevating and depressing portions experience changes in their angles of incidence which are accompanied by a variety of possible alterations in their lift to drag ratios. These can have the effect of redistributing its lift and drag such that the lift and towing force resultant, and the drag vector are separated across the direction of movement at any one moment. This gives rise to further couples that either work with or against the opposed lift component couples, depending on the angles of incidence at which the hydrofoil surfaces had been working. A common result is that of repeated and alternating turns towards the surface, sometimes developing into a marked or even violent "porpoising" action.

Furthermore, if the apparatus should suffer disorientation due, for example, to an acquired drag force from weed, debris or from grounding, the surface sensing capability can be overcome, due to large changes, of an opposite nature, between the angles of incidence of the elevating and depressing portions. This can cause the apparatus to turn and jump from the water, dive beneath the vessel or, in the case of grounding, dive precipitously into the bottom.

The addition of a short stabilizing tail works with the opposed lift component couples to support any turns towards the water surface, which is unhelpfull. However, as the tail is lengthened, this support becomes increasingly less, tending more to support the maintainance of a fixed orientation, with respect to the general direction of advance of the hydrofoil apparatus, so obliging it to execute its surface sensing with a more side-slipping action. The longer the tail, therefore, the more turns towards the surface and "porpoising" are suppressed. However, while this modification of behaviour is appropriate, it is found in practice to be insufficient, unless the tail is unacceptably long.

A further disadvantage can arise if a bridle member parts and, as a consequence, the apparatus adopts completely the wrong orientation. Due to the anhedral relationship of the hydrofoil surfaces, the apparatus can then behave much as a spinner does on a fishing line, causing considerable entanglement and further loss or damage.

For many uses it is important that the drag of a towed hydrofoil apparatus be reduced as much as possible, and particularly so for sailing. An immersed tow-line and bridle members can generate excessive drag if not satisfactorily faired. However, the effectiveness of known cable fairings that are used in a much wider context than just the present invention is limited because they are designed to feather freely about a towed cable. Consequently, a bridle member, tow-line or towed cable that is faired in this a must have a circular cross-section which imposes a lower limit to the thickness of fairing section that can be used around it. This in turn imposes a limit on the degree of drag reduction that is possible.

SUMMARY OF THE INVENTION

It is an aim of the present invention to provide hydrofoil apparatus which may be designed and or adjusted to operate at a wide range of speeds and angles of incidence, either deeply submerged or at the water surface while sensing the water surface dynamically, in smooth as well as rougher water, to one or to either hand of the towing point, and which decreases or eliminates the above mentioned disadvantages of simple anhedral surface sensing.

Accordingly, the present invention, in one non-limiting embodiment, provides hydrofoil apparatus comprising a first hydrofoil member having chord and span dimensions and positive hydrodynamic pitching moments, a second hydrofoil member having chord and span dimensions and positive hydrodynamic pitching moments, connection means for connecting the first and second hydrofoil members together such that they are able to articulate about the connection means, at least first and second bridle members which are for enabling the hydrofoil apparatus to be towed and are such that the first bridle member is articulately attached at one end to an outer end portion of the first hydrofoil member thereby forming a first pitching axis, the second bridle member is articulately attached at one end to an outer end portion of the second hydrofoil member thereby forming a second pitching axis, the first and second pitching axes forming an angle such that a component of hydrodynamic lift generated by the first hydrofoil member and a component of hydrodynamic lift generated by the second hydrofoil member act in parallel directions away from each other, and regulation means by which the angle formed by the first and second pitching axes is regulated.

The connection means may, in some embodiments of the present invention, comprise no more than one or a series of loose but captive links and/or flexible members of low torsional resistance, provided that the first and second hydrofoil members are permitted sufficient freedom to pitch.

The first and second hydrofoil members of the present invention have similar functions to the anhedral portions of a simple anhedral hydrofoil apparatus in that components of their hydrodynamic lift act in parallel and opposite directions away from each other. They differ, however, in that they have freedom to pitch about their pitching axes and have positive hydrodynamic pitching moments by which they each seek to adopt and maintain particular angles of incidence. When, therefore, the hydrofoil apparatus of the present invention acquires drag from attached weed, debris or from grounding, that would destabilize the simple anhedral hydrofoil apparatus, each hydrofoil member is able to adopt the appropriate angles of incidence that are required to maintain a balance in their opposing lift components. The hydrofoil apparatus therefore adopts a particular angle of sweep at which the couple formed by the horizontal separation of the opposing lift components is equal and opposite to that introduced by the drag force, enabling the hydrofoil apparatus to continue in the same general direction of advance, though with a changed orientation.

The angle formed by the first and second pitching axes requires at least some regulation by the regulation means because the most efficient hydrofoil apparatus will be that which has the greatest angle that is consistent with the minimum anhedral necessary for satisfactory surface sensing. Without regulation that sets a minimum angle, the angle adopted by the pitching axes would become considerably less than that desired and an uncertain variability would interfere with the normal functioning of the hydrofoil apparatus in several respects. However, it can be desirable that the minimum angle permitted is variable, and it can also be desirable that the regulation means permits a free increase of angle, somewhat above a minimum. If, then, a bridle member should part, causing the hydrofoil apparatus to adopt completely the wrong orientation, its anhedral is free to decrease or even pass beyond 180 degrees to a dihedral angle, so lessening or avoiding further damage and entanglement due to spinning.

The regulation means may include a third bridle member that is articulately attached at one end to the connecting means or to the inner end portions of the first and second hydrofoil members at locations that lie substantially on their pitching axes. Alternatively or as well the regulation means may include at least one strut, which may be hydrodynamically faired, having a first end which is articulately connected to the first hydrofoil member at a location that lies substantially on the first pitching axis and is displaced from the connecting means and a second end that is articulately connected to the second hydrofoil member at a location that lies substantially on the second pitching axis and is displaced from the connecting means. In order then to avoid spinning, a free increase of the regulated angle is permitted, for example, when; the distance between the first and second attached ends of the strut is free to increase above a certain minimum; and/or at least one attached strut end, is free to move in a generally spanwise direction, away from the outer end of its respective hydrofoil member, but is moved to an outer spanwise limit by the strut, when it comes under compression, the strut end/s then becoming substantially confined in a chordwise direction.

Alternatively or as well, the regulation means may include regulation that is provided in conjunction with the connection means. This occurs when the connection means is provided with a first connection axis about which the first hydrofoil member turns and a second connection axis about which the second hydrofoil member turns, the first and second connection axes being coaxial with the first and second pitching axes. In this case, in order to avoid spinning, a free increase of the regulated angle is permitted, for example, when the connection means includes at least one intermediate connecting member which turns about the first and/or second connecting axis, and which is articulately connected to its respective hydrofoil member such that a free increase of the regulated angle that lies to the pressure sides of the hydrofoil members is possible.

There is a further advantage if the regulation means will permit the first and second hydrofoil members to fold together, but only with their suction surfaces facing each other, the hydrofoil members having passed through the angles of anhedral as well as dihedral. This may be provided for in the same ways as described above for providing a free increase of the regulated angle, but with the range of freedom being appropriately extended. With this facility the normal operation of the hydrofoil apparatus remains unaltered, but it becomes possible to fold the hydrofoil members together, for ease of stowage and handling.

For many embodiments of the present invention it is a desirable control feature that the positive pitching moments of the hydrofoil members may be brought into opposition with one another. Such opposition means provides a reciprocal relationship by which an increase or decrease in the angle of incidence achieved by one hydrofoil member imposes a decrease or increase, respectively, on that which can be achieved by the other. The opposition means may be provided by a strut, as described above for the regulation means, except that its ends are attached to their respective hydrofoil members at locations that are displaced backwards from their respective pitching axes. The strut then still provides regulation as well, to the extent that it determines the minimum angle that the regulated angle may adopt.

Alternatively or as well, the connection member may provide opposition means in an equivalent way to that provided by a strut, as described above. For this alternative, the first and second connection axes are instead arranged to diverge backwards from the first and second pitching axes, respectively, as they reach towards the outer ends of their respective hydrofoil members, instead of being coaxial with them. The connection member then still provides regulation as well, to the extent that it determines the minimum angle that the regulated angle may adopt.

As with the simple anhedral hydrofoil apparatus, the hydrofoil apparatus of the present invention may be adjusted in role, to sense the water surface by adjusting the relative lengths of its bridle members. When the hydrofoil apparatus rises and falls, during surface sensing, the opposing lift components would, like the simple anhedral apparatus, tend to give rise to a "porpoising" action.

However, the hydrofoil apparatus of the present invention does not normally employ a stabilizing tail. It is instead arranged that its lift and drag are redistributed such that, during normal operation, the resulting couples work against any opposed lift component couples to maintain its orientation with respect to its general direction of advance and not its direction of movement at any one moment. The hydrofoil apparatus therefore conducts its surface sensing movements with a side-slipping action. This may be achieved through the addition or removal of drag in appropriate ways. For example; at least one controllable drag rudder may be employed. Alternatively or as well, at least one of the hydrofoil members of a hydrofoil apparatus may have at least one end portion that includes at least one separate, full or part chord of hydrofoil surface which is orientated such that when the end portion is trailing, the hydrodynamic pitching moment of that portion is higher than when it is leading. The drag associated with generating a positive pitching moment is thereby increased when trailing. Furthermore, if each of the opposite end portions of the hydrofoil member have similar characters in this respect, drag is both removed from its leading end portion and added to its trailing end portion with little or no change to the pitching moment of the hydrofoil member as a whole. This is not necessarily desirable, however, when the hydrofoil apparatus is adjusted to have a small unwetted portion piercing the water surface. In this case, small changes of immersion would be accompanied by large changes of pitching moment. The separate or part chord hydrofoil surface of such a portion may therefore be arranged to have little or no influence over the hydrofoil member's pitching moments, except when the outer end portion is trailing. To achieve this, it may be articulately mounted on its outer end portion and permitted to self feather, to its apparent water flow, when its end portion is leading, and only become active in generating positive pitching moments when its end portion is trailing.

Alternatively or as well, it can be arranged that, during surface sensing depth corrections, the lift to drag ratio of at least one of the hydrofoil members is altered by causing its angle of incidence to change appropriately, which will have the consequence of altering the distribution of lift as well as of drag, for the whole immersed apparatus.

When the distribution of lift and of drag for the whole hydrofoil apparatus is altered through a change in the angle of incidence of at least one of its hydrofoil members, it is not only the redistribution of lift and drag between the two hydrofoil members that determines the outcome, but also any redistribution that occurs between different portions of the individual hydrofoil member. The nature of this redistribution depends upon the lift to drag characteristics of the portions of hydrofoil member concerned. For example, an elevating hydrofoil member having considerable twist (in the form of wash-out) may increase its angle of incidence when, in the course of sensing the water surface, its degree of immersion is increased. While thereby maintaining a comparatively high lift to drag ratio on the portion that, at any one moment, is operating just below the water surface, its portion that is most deeply immersed experiences a marked increase in its angle of incidence, giving it high lift but also very high drag. This usefully redistributes both lift and drag as well as increasing the restoring force beyond that due to the increase of immersed area alone.

The distributions of both lift and drag will also change in characteristic ways with changes in the hydrofoil member's angle of sweep with respect to its apparent water flow. Furthermore, if the hydrofoil member has movable control surfaces, or it deforms under load, its characteristic responses to the above mentioned experiences be altered.

The hydrofoil member acquires its lift to drag ratio characteristics from all aspects of its form. It may, for example, have straight or concave and convex surfaces along its span; be twisted in one or both hands; be of constant or varied chord; be of straight, curved or irregular planform; be of constant or varied cross-section along its span and be single-plane or multi-plane and may also have at least one separate control surface. Also, the first and second hydrofoil members need not necessarily be the same or mirror each other.

Similarly, the hydrofoil member acquires its pitching moment characteristics from all aspects of its form, as exampled above for its lift to drag characteristics. At least one control surface and/or deformation under load may be used to change the characteristic hydrodynamic pitching moments of at least one of the hydrofoil members. They may also be influenced by changes in immersion and/or angle of sweep.

The angles of incidence that the hydrofoil members adopt may be further influenced by controlling the strength of opposition, since, in addition to its reciprocal nature, the opposition means provides a differential mechanism by which dual control can be exercised over the angles of incidence that the first and second hydrofoil members are permitted to achieve. This occurs, for example, when the strength of opposition is controlled by varying the distance between the attached ends of a strut that is providing the opposition means; by varying the position of attachment of at least one of the attached strut ends on its respective hydrofoil member; by varying the angle at which at least one of the connection axes diverges from its respective pitching axis; and/or by varying the regulated angle.

Pitching limitation means, whereby at least one of the first and second hydrofoil members has only limited freedom to pitch, are desirable for many embodiments of the present invention. This is particularly so whilst the apparatus is being operated at very low speeds and angles of incidence, when the pitching and stabilizing hydrodynamic forces are low. Pitching limitation means may be provided, for example; by limiting a hydrofoil member's freedom to pitch about its respective connection axis; or, if a strut is present, the shape of the strut attachment end, and of the hydrofoil member, over their respective surfaces that come to bear against each other, may be such that pitching is limited in the desired way. For example, a protruberance reaching forwards and or backwards from one or both of a strut's attachment ends may be so shaped that it comes to bear on the respective hydrofoil member, inhibiting further decrease or increase in pitch beyond the desired limit/s. As a further example, the bearing surface of the hydrofoil member may be of a socket nature, to receive the strut end, its movement being restricted as desired within the socket.

It will be appreciated from the description above that there are many ways of imparting and configuring the many characteristics of the hydrofoil members and their interaction, in order to fulfill the wide range of requirements found within the different types of use to which the hydrofoil apparatus may be put. For example, the operating environment at a water-air interface is asymmetrical and can therefore, in some respects, be best met with an asymmetrical hydrofoil apparatus. In order, therefore, to operate efficiently at the surface and to either hand, such asymmetry may need to be reversable. However, none of these many ways would depart from the underling principles by which the hydrofoil apparatus functions.

Many embodiments of the present invention will include at least one means of controlling their character and behaviour, to suit different purposes and circumstances. The adjustments needed may be controlled by, for example, any combination of the following; by pre-setting; by remote control, by the control of surface and/or bottom sensing equipment; by the control of pressure sensing equipment; by the control of motion sensing equipment; and/or by the control of load sensing equipment.

One form of pre-setting and/or remote control may include bridle adjustments. As described above, the primary controlling effect of altering the relative lengths of bridle members is to alter the orientation of the first and second hydrofoil member's lift vectors, and so vary the elevating and depressing lift components.

However, in altering the bridle member lengths the geometry formed by them and the first and second pitching axes is also changed. These changes may therefore be used to provide secondary controlling functions that give further desirable modifications of the first and/or second hydrofoil members characters and of the ways they interact.

Secondary controlling functions may include, for example, varying the strength of the opposition means by either; retaining the same regulated angle, but altering the effect of a strut that is providing opposition, (e.g. by moving at least one of its attachment locations on its respective hydrofoil member); or by retaining the same strut attachment locations, but altering the regulated angle.

Also, secondary controlling functions such as, for example, the movement of the strut attachment locations on their respective hydrofoil members, as mentioned above, and/or changing the pitching moment and/or lift and drag characteristics of at least one of the hydrofoil members, may be controlled through an interactive effect which takes place when the angle formed by at least one of the first and second pitching axes, and a bridle member, is altered, through at least one bridle member length adjustment. It may then be desirable that modulation means are employed whereby these secondary controlling functions are modulated, in varying proportionate ways, to work more appropriately with the primary controlling functions that they accompany. It is also desirable that secondary controlling functions provided in this way are unaffected by pitching of the hydrofoil member concerned, or at least, are affected only to an extent that is desirable.

To minimise the drag of bridle members and or tow-lines, at least a part of at least one of the bridle members, and/or tow-line may be of an aero hydrodynamically faired cross-section. Such a faired cross-section may be of a super-cavitating type.

Equipment such as, for example, controlling mechanisms, activating devices, power sources and any special equipment may all be housed within any of the members of the hydrofoil apparatus and/or attached to its bridle and/or towlines. Also power; control information and/or data information may be passed along at least one of its bridle members and/or tow-line, and control information and or data information may be passed by other remote means.

At least two of the constituent members of the hydrofoil apparatus may be easily disassembled, in order to facilitate its handling and stowage.

BRIEF DESCRIPTION OF THE DRAWINGS

Embodiments of the invention will now be described solely by way of example and with reference to the accompanying drawings, in which.

DISCLOSURE OF THE PREFERRED EMBODIMENT

Figure 1:
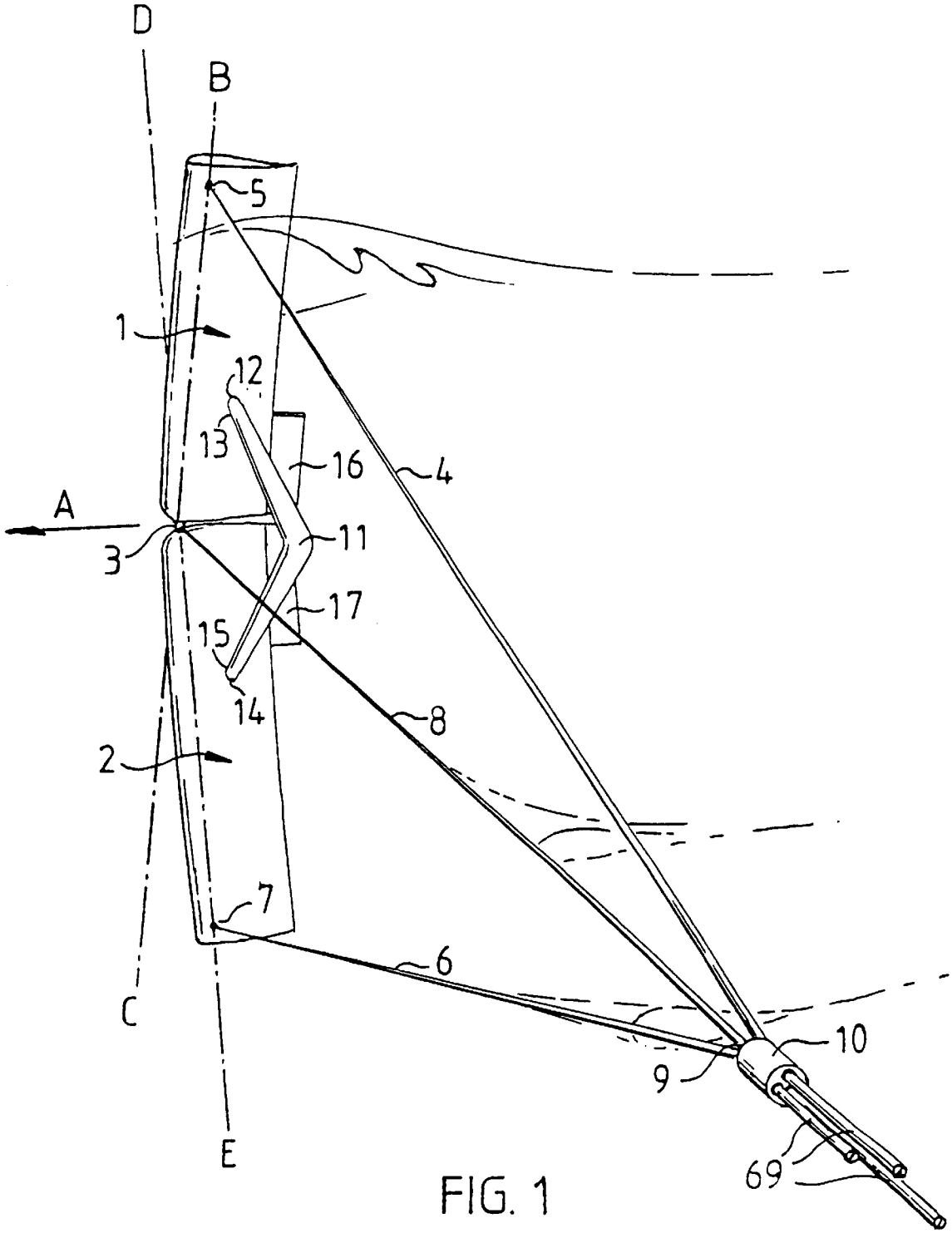
FIG. 1 is a perspective view illustrating a hydrofoil apparatus constituting an embodiment of the invention.

Referring to the drawings, FIG. 1 is a perspective illustration of a hydrofoil apparatus having hydrofoil members 1 and 2 that mirror each other and which is being towed with a substantially vertical orientation at the water surface, on the starboard hand, and is viewed from a position somewhat ahead and above the point from which it is being towed. A portion of hydrofoil member, one bridle member and a portion of two more bridle members are shown above the water surface. The arrow A indicates its general direction of advance.

The first hydrofoil member 1 having positive pitching moments and the second hydrofoil member 2 having positive pitching moments, are articulately connected to each other by a connection means 3. A first bridle member 4 has an end 5 which is articulately connected to the outer end portion of the first hydrofoil member 1, thereby forming the first pitching axis BC, about which the first hydrofoil member 1 has at least some freedom to pitch. A second bridle member 6 has an end 7 that is articulately connected to the outer end portion of the second hydrofoil member 2, thereby forming the second pitching axis DE, about which the second hydrofoil member 2 has at least some freedom to pitch. A third bridle member 8 is articulately connected to the connection means 3. When under tension, the bridle members 4,6,8 act as part of the regulation means whereby the angle formed by the first and second pitching axes BC, DE, and which lies to the pressure side of the first and second hydrofoil members (the regulated angle), is regulated by the relative lengths of the bridle members, and changes in their relative lengths may thereby provide a means of control. The first, second and third bridle members 4,6,8 are brought together to form the towing point 9 of the bridle which, in this embodiment, is accompanied by a fairlead 10 through which at least one of the bridle members has some freedom to run, beyond which they act as tow-lines 69 and thereby enable adjustments to the relative lengths of the bridle members to be carried out from a remote towing point. There is shown a hydrodynamically streamlined strut 11 which has a first end 12 which is articulately connected to the hydrofoil member 1 at the location 13 which is behind the first pitching axis BC, and a second end 14 which is articulately connected to the second hydrofoil member 2 at the location 15 that is behind the second pitching axis DE. When the strut 11 is under compression, it provides opposition means by which the pitching moments of the first and second hydrofoil members may act in opposition to each other. Bridle adjustments that decrease the regulated angle will increase the force compressing the strut 11 as it carries the increasing opposition force, thereby providing duel control over the angles of incidence that the hydrofoil members 1,2 are permitted to achieve. The strut 11, however, still forms a part of the regulation means, since it regulates the minimum angle to which it is possible to reduce the regulated angle. The control surfaces 16, 17 provide moment variation means by which the pitching moments of the hydrofoil members 1,2, respectively, may be adjusted or controlled.

Figure 2:
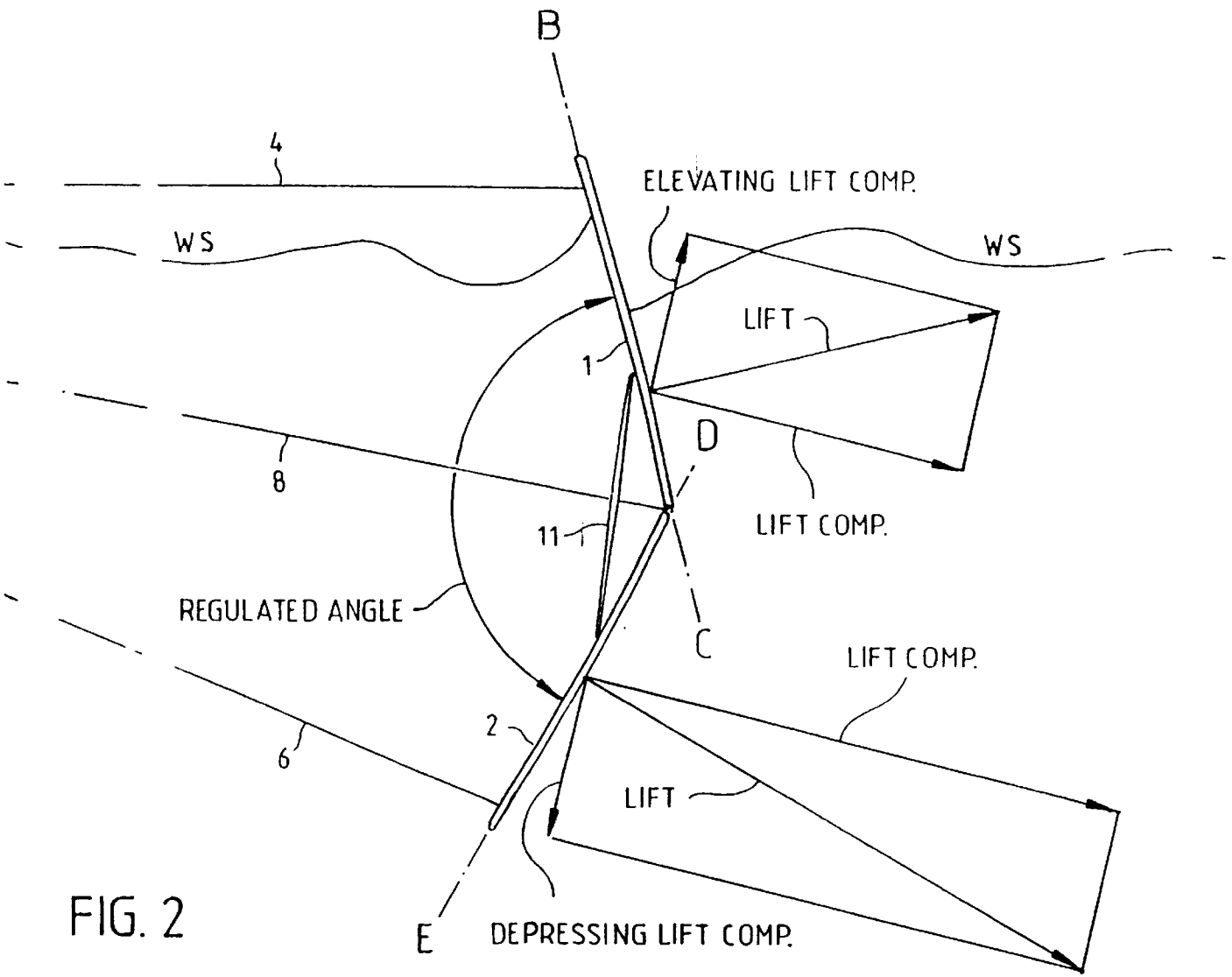
FIG. 2 is a schematic diagram illustrating the lift forces acting on the hydrofoil apparatus of FIG. 1.

FIG. 2 is a schematic diagram of the hydrofoil apparatus of FIG. 1 when viewed from behind and while running at the water surface WS with the correct degree of immersion for which it is adjusted. The diagram illustrates the origins and orientations of the lift vectors of the hydrofoil members 1,2 together with their elevating and depressing lift components, which contribute to the effort generated by the hydrofoil apparatus as drag, and the lift components that contribute to its effort as lift. The regulated angle is also indicated.

Figure 3:
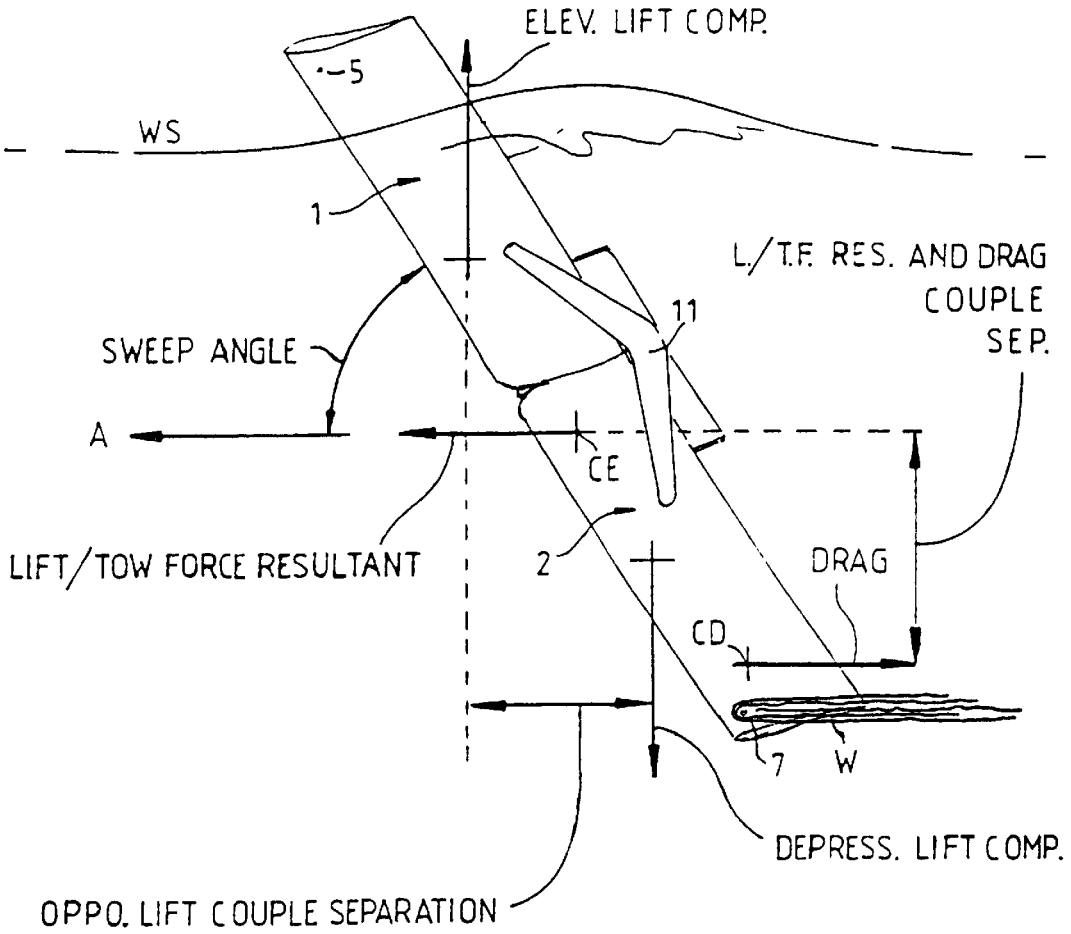
FIGS. 3 and 4 are schematic diagrams illustrating the origin of different couples that act on the hydrofoil apparatus of FIG. 1, in different circumstances.

FIG. 3 is a schematic diagram of the hydrofoil apparatus of FIGS. 1 and 2, when viewed from its pressure side, and illustrates how, when the apparatus experiences acquired drag, for example, from attached weed, debris or from grounding, it can compensate by adopting a new orientation. The hydrofoil apparatus is shown with a considerable angle of sweep, with respect to its general direction of advance A. This is due to an acquired drag force from weed W that has become caught towards the end of the second bridle member 7 and which has brought the center of drag CD for the hydrofoil apparatus considerably lower than normal, towards the outer end of the second hydrofoil member 2. This has caused a separation, across the general direction of advance A, between the lift and tow force resultant, and the drag vector, producing couples that seek to increase the angle of sweep. However, as sweep is increased, there occurs a separation, along the general direction of advance A, between the opposed elevating and depressing lift components, which gives rise to couples that work to arrest the development of further sweep. A new balance is therefore found and the apparatus can continue in the general direction of advance A, but with a changed orientation.

Figure 4:
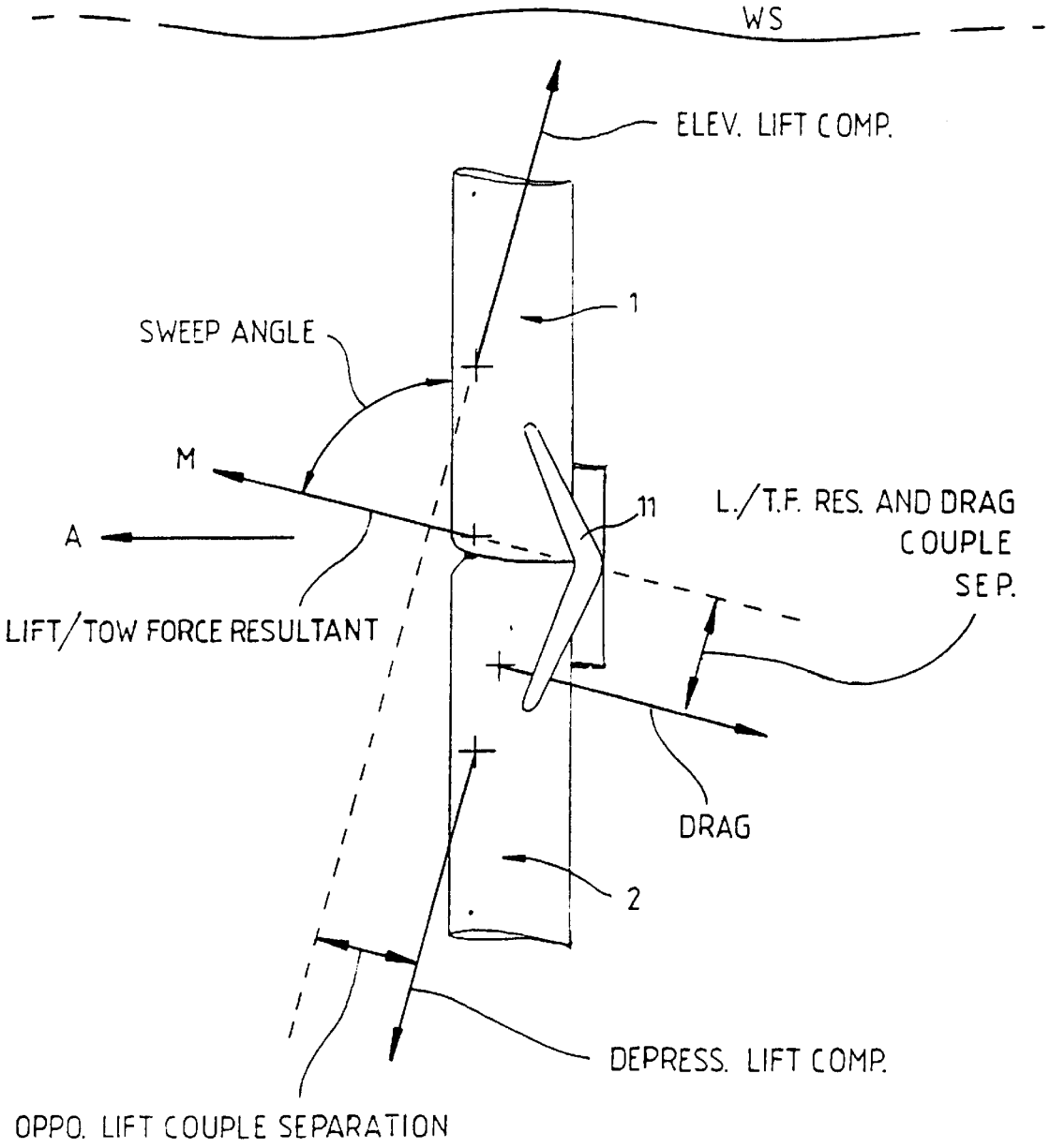

FIG. 4 is a schematic diagram of the same hydrofoil apparatus and with similar adjustments to that in FIGS. 1,2 and 3 but seen when it has become too deeply immersed and so is in the process of being restored to its correct running depth, in response to an elevating lift resultant. The arrow A indicates its general direction of advance, while the arrow M indicates its direction of movement at the moment of illustration. The opposed lift components have become separated along the direction M giving rise to couples that seek to turn the hydrofoil apparatus towards the surface and risk initiating a "porpoising" action. However, due to the special character and measures built into the hydrofoil apparatus, the distribution of its lift and drag has been altered, in response to its greater immersion, such that its lift and tow force resultant and its drag vector have become separated across the direction M to give couples that work against the opposed lift component couples. A balance is found whereby the hydrofoil apparatus maintains much the same orientation, with respect to its general direction of advance A while taking on sweep with respect to its direction M, so regaining its correct depth of immersion with a side-slipping action.

It is desirable that the surface sensing response to a depressing lift resultant is of the same, but inverted, side-slipping action as that described above. However, in practice it is often found that to inhibit the rising half of the "porpoising" cycle more than the falling half can be sufficient.

Figure 5:
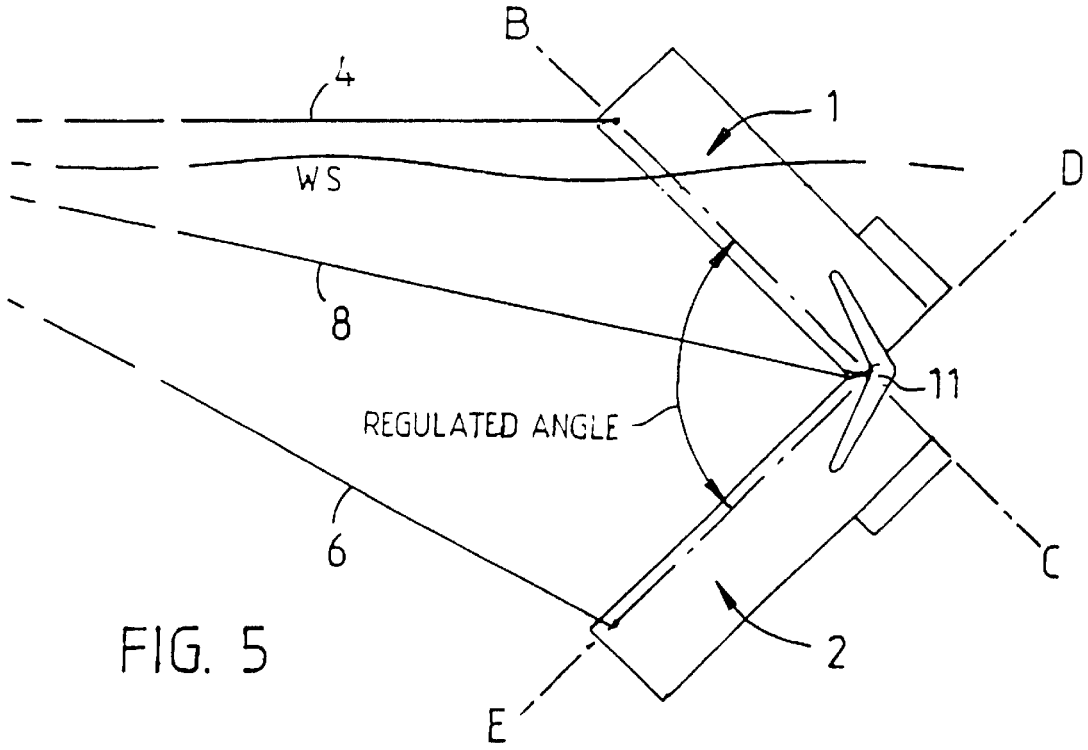
FIGS. 5 and 6 show views of the hydrofoil apparatus of FIG. 1, when adjusted for very low effort, viewed from its pressure side and from behind respectively.

FIG. 5 is an illustration of the hydrofoil apparatus in FIG. 1 when adjustments to the bridle members have made the third bridle member 8 considerably longer than the first and second bridle members 4, 6. The regulated angle has consequently been reduced to a minimum permitted by the strut 11 acting in its role as part of the regulation means. At the same time, compression of the strut 11 has increased, so strengthening the opposition which gives dual control over the angles of incidence that the first and second hydrofoil members 1, 2 are permitted to achieve, reducing both their angles of incidence to a minimum. The hydrofoil apparatus then operates at a very low lift to drag ratio and produces very little lift. The launch and recovery of the hydrofoil apparatus can be much simpler and safer when in this condition, especially at speed and in rough water.

Figure 6:
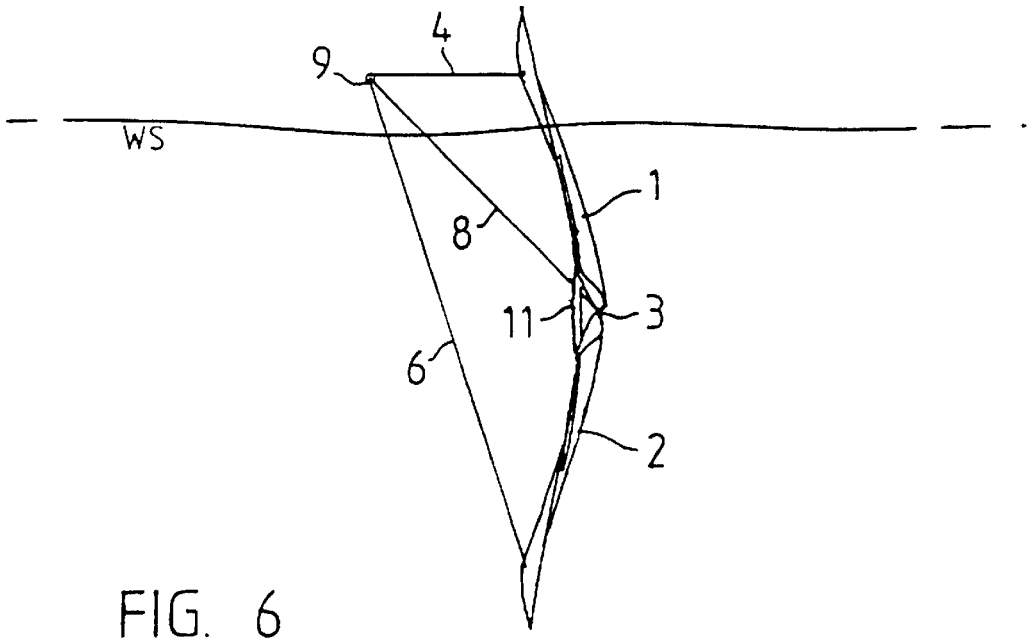

FIG. 6 is an illustration of the hydrofoil apparatus in FIG. 5, when seen from behind.

Figure 7:
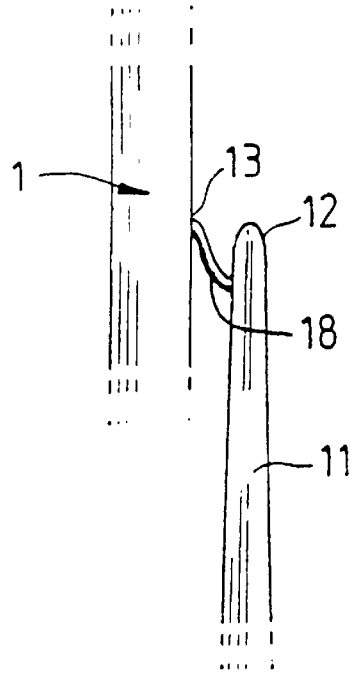
FIGS. 7 and 8 are illustrations of a strut end attachment to a hydrofoil member in two positions, and when viewed from in front.

FIG. 7 is an illustration of an example of strut attachment that permits some freedom of movement for an attached strut end to move away from the outer end of its respective hydrofoil member. A portion of the first hydrofoil member 1, together with the attached end 12 of the strut 11 are seen from in front. The attached strut end 12 is shown moved away from the hydrofoil member 1, but still retained by the flexible or articulated first attachment member 18 by which it is attached to the hydrofoil member 1 at the first attachment location 13.

Figure 8:
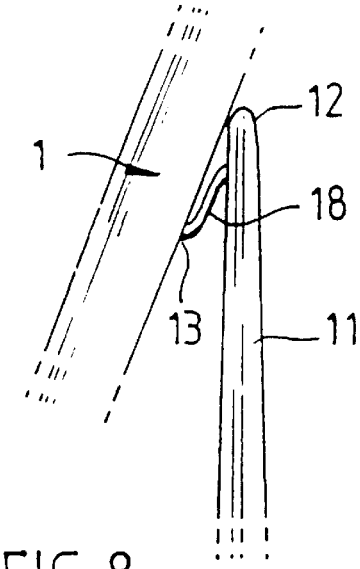

FIG. 8 is an illustration of the same strut attachment and view as FIG. 7, except that the strut 11 has come under compression, which has put the attachment member 18 in tension, so bringing the attached strut end 12 to bear against the hydrofoil member 1 at its outer spanwise limit, to function as the opposition means.

Figure 9:
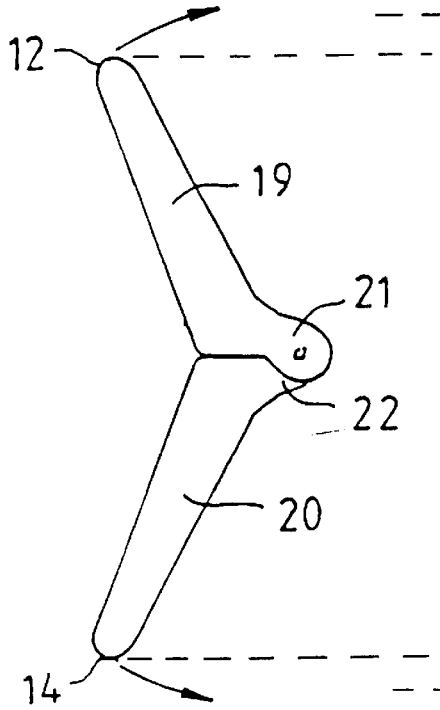
FIGS. 9 and 10 are illustrations of a strut having movable connection ends, when viewed from its side, and with the connection ends in two different positions.

FIG. 9 is an illustration of an example of a strut on which the distance between the first and second attached ends 12,14 is free to increase above a minimum. The strut comprises two strut members 19,20 that are articulately connected to each other at their first and second connection ends 21,22 such that the attachment ends 12,14 are each free to move a limited distance over an arc that alters their separation. The limitation to their movement may be such that the attachment ends 12,14 never become diametrically opposed, or it may be such that they are free to move to either side of this point, but are returned to the correct side for normal operation by resilient means.

Figure 10:
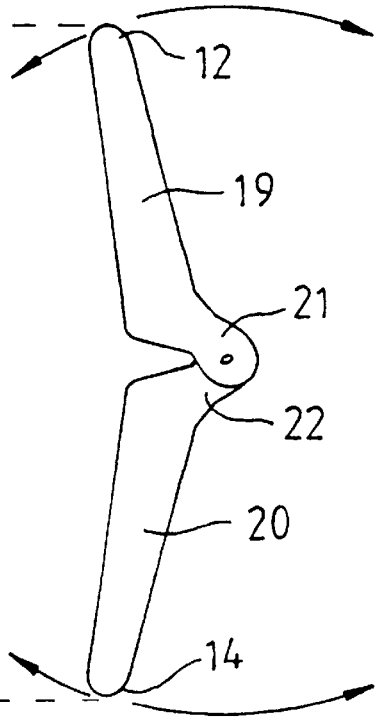

FIG. 10 is an illustration of the same strut as that shown in FIG. 9, but when the distance between the strut ends 12,14 has increased until they are nearly diametrically opposed.

Figure 11:
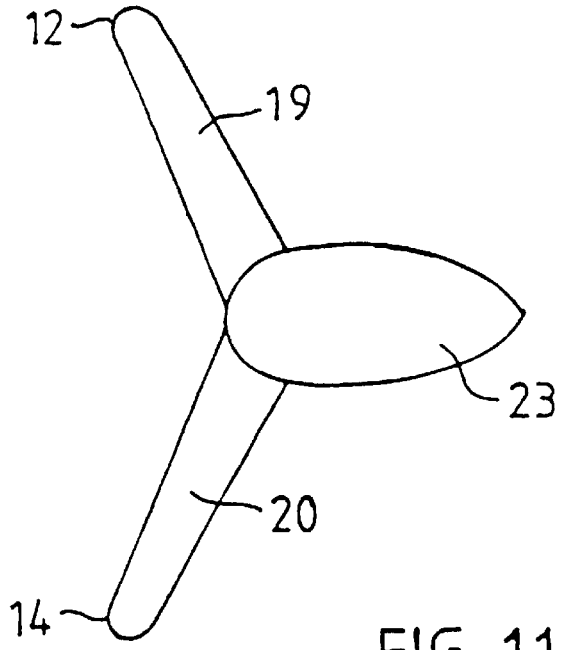
FIG. 11 is an illustration of a similar strut to that in FIGS. 9 and 10 but includes a body housing control mechanisms.

FIG. 11 is an illustration of a strut that is similar to that in FIGS. 9,10, but in which a control mechanism (not shown), housed within the body 23, gives control over the minimum separation between the attachment ends 12,14, so providing control over the strength of the opposition means.

Figure 12:
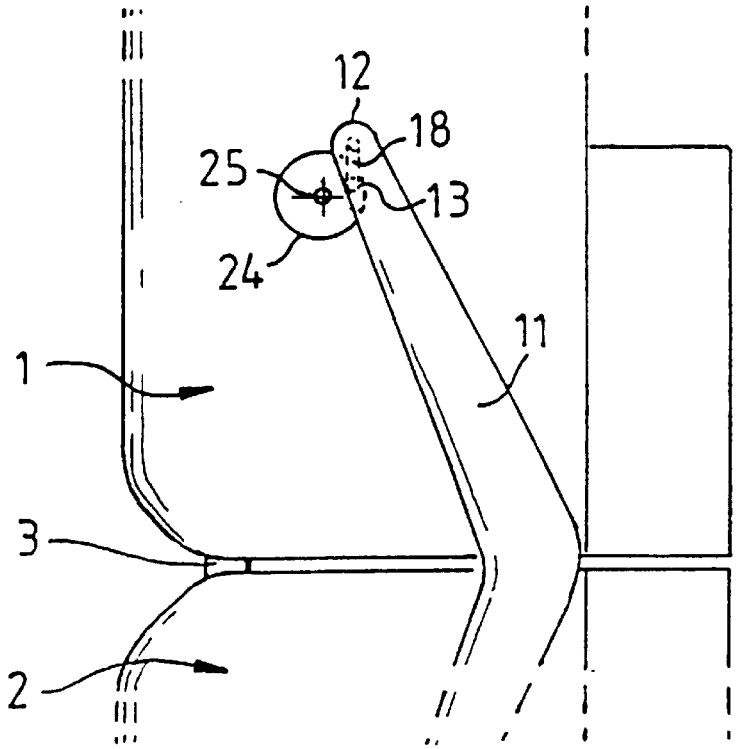
FIG. 12 an illustration of a similar strut end and hydrofoil member portion as that in FIGS. 7 and 8, but when viewed from its pressure side.

FIG. 12 is an illustration of a strut attachment similar to that shown in FIGS. 7,8, but when seen from the pressure side. The first attachment member 18 attaches the first attached end 12 to the first hydrofoil member 1 at the attachment location 13 which is situated on the disc 24 at a position that is displaced from its center 25. The disc 24 may be rotatable by a control mechanism (not shown) whereby the attachment location 13 on the hydrofoil member 1 may be varied, so providing control over the strength of the opposition means. Alternatively, it may simply have a degree of freedom to rotate, allowing the strut attachment location 13 to move away from a certain minimum distance from the outer end of the first hydrofoil member, thereby using the regulated angle freedom to increase above a regulated minimum. The hydrofoil members 1,2 are shown connected by a flexible connecting member 3 of low torsional resistance.

Figure 13:
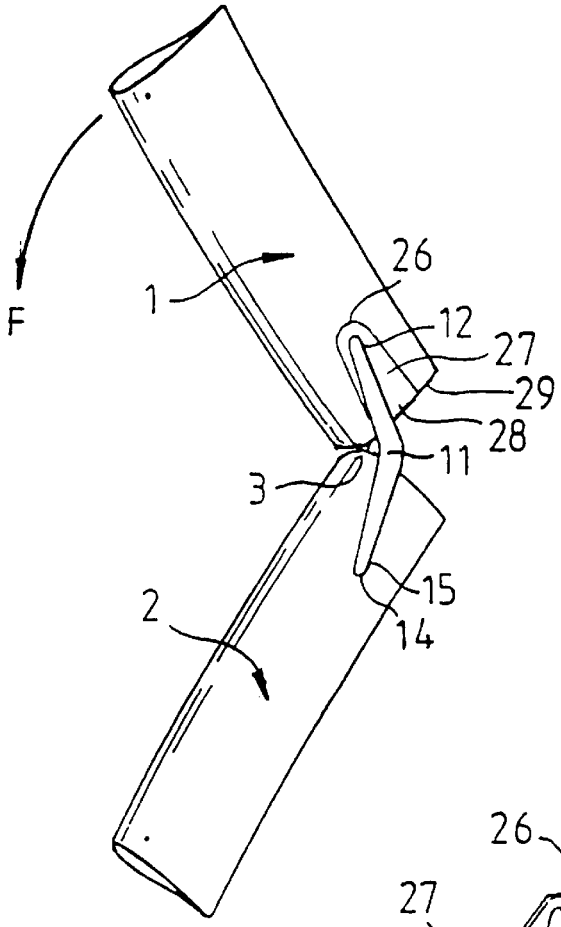
FIGS. 13, 14 and 15 are perspective illustrations of the same hydrofoil apparatus and with the same bridle adjustment, as that in FIGS. 5 and 6, and illustrate three stages in the folding together of the first and second hydrofoil members.
Figure 14:
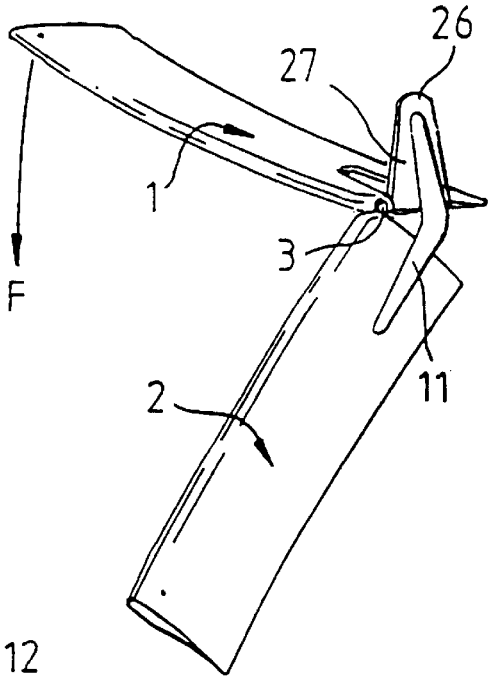
Figure 15:
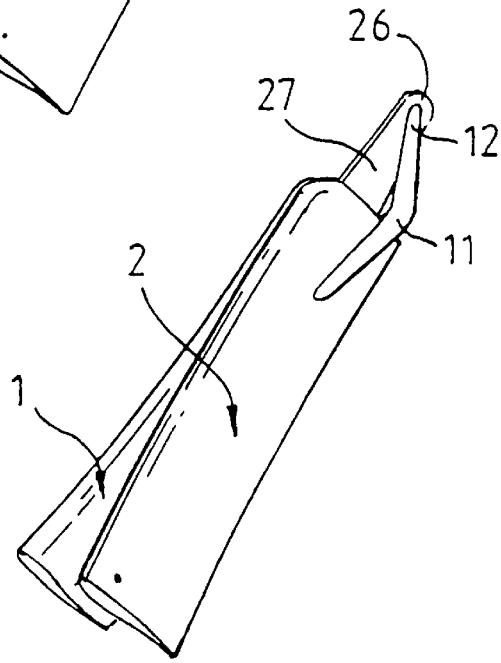

FIGS. 13,14 and 15 are three perspective illustrations of a similar hydrofoil apparatus to that shown in FIGS. 5 and 6, and with the same bridle adjustments, when seen from its pressure side. They illustrate three stages in the folding together of the first and second hydrofoil members 1,2 such that their suction surfaces come to face each other, as shown in FIG. 15. The arrows F indicate the folding movement. The second attached end 14 of the strut 11 is articulately attached to the second hydrofoil member 2 at location 15. The first attached end 12 of the strut 11 is articulately attached to the outer end 26 of the intermediate attachment member 27 while the inner end 28 of the intermediate attachment member 27 is articulately connected to the inner end 29 of the hydrofoil member 1, such that when the hydrofoil members are being unfolded again, the strut attachment to the intermediate attachment member 27 is guided to its location for normal operation on the first hydrofoil member 1, as shown in FIG. 13.

Figure 16:
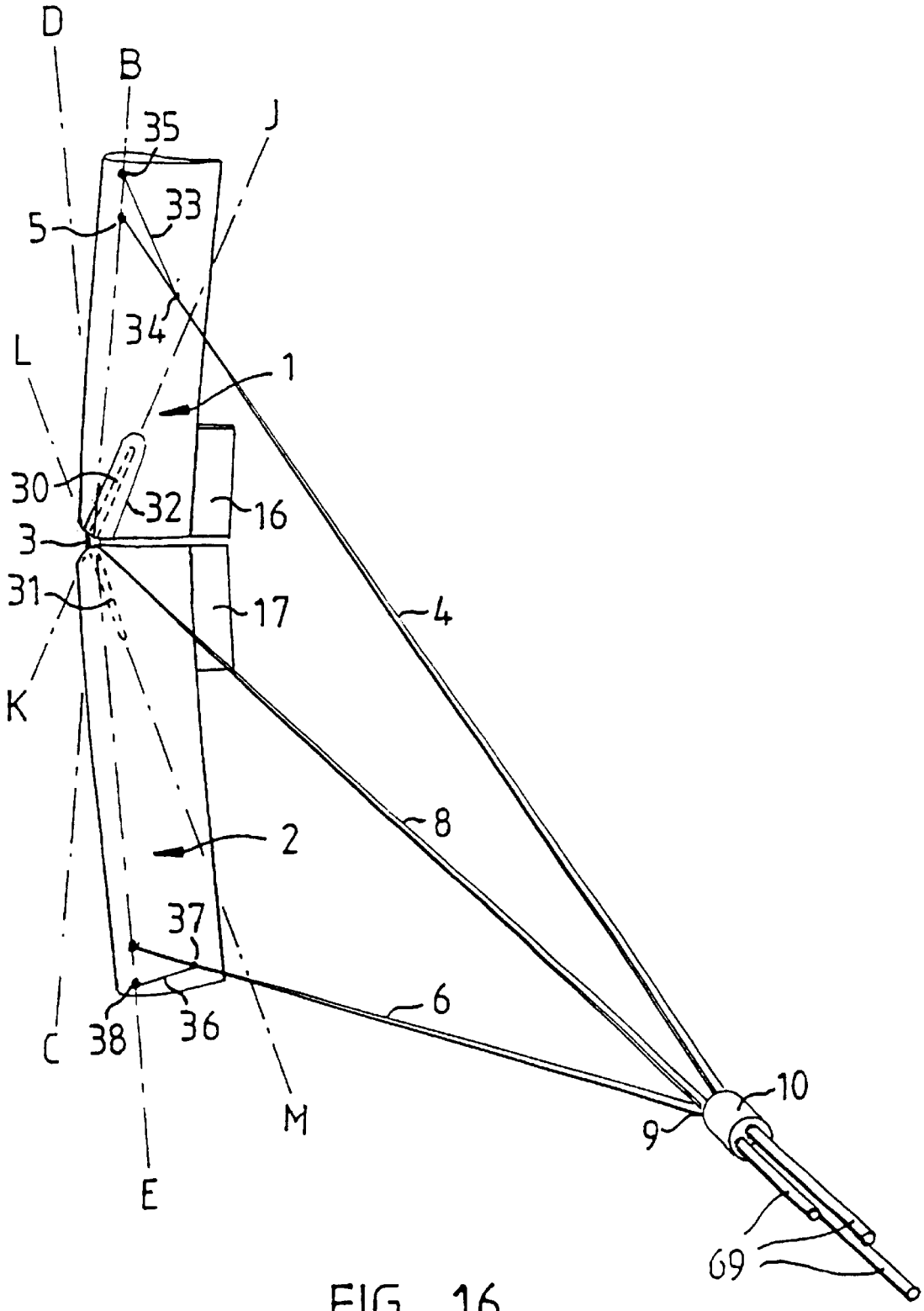
FIG. 16 is a perspective illustration of a hydrofoil apparatus constituting another embodiment of the present intention that is viewed from the same position as that in FIG. 1.

FIG. 16 is a perspective illustration of a further embodiment of the invention that is similar to that shown in FIG. 1 and is seen from the same position. In this embodiment, however, the connection member 3 provides both the connection means and the opposition means, through being provided with a first connection axis JK about which the first hydrofoil member 1 turns on the shaft 30 of the connecting member 3 and a second connection axis LM about which the second hydrofoil member 2 turns on the shaft 31 of the connection member 3, the first and second shafts 30,31 diverging backwards from their respective pitching axes BC,DE. The connection member shaft 30 turns in the intermediate connection member 32. Also, in this embodiment, the end 5 of the bridle member 4 is articulately attached to the hydrofoil member 1, on its outer end portion, establishing the first pitching axis BC. The first control line 33 is attached at some distance from the end 5 of the bridle member 4, at the point 34, the first control line's other end passes through a first fairlead 35 on the hydrofoil member 1 at a location that is displaced from the attachment of the bridle member end 5, but which lies on or very close to the pitching axis BC such that when the hydrofoil member 1 pitches, there is only such movement of the control line 33 through the fairlead 35 that is desirable. Bridle member length adjustments that alter the angle formed by the bridle member 4 and the pitching axis BC cause movement of the control fine 33 which leads through the fairlead 35 to a mechanism (not shown) providing secondary control functions which may include varying the strength of the opposition means and or changing the pitching moment and/or lift and drag characteristics of the first hydrofoil member. Similarly, on the second hydrofoil member 2 the second control line 36 is attached to the bridle member 6 at the point 37 and passes through the fairlead 38 to provide secondary control functions which may include varying the strength of the opposition means and/or changing the pitching moment and/or lift and drag characteristics of the second hydrofoil member 2.

Figure 17:
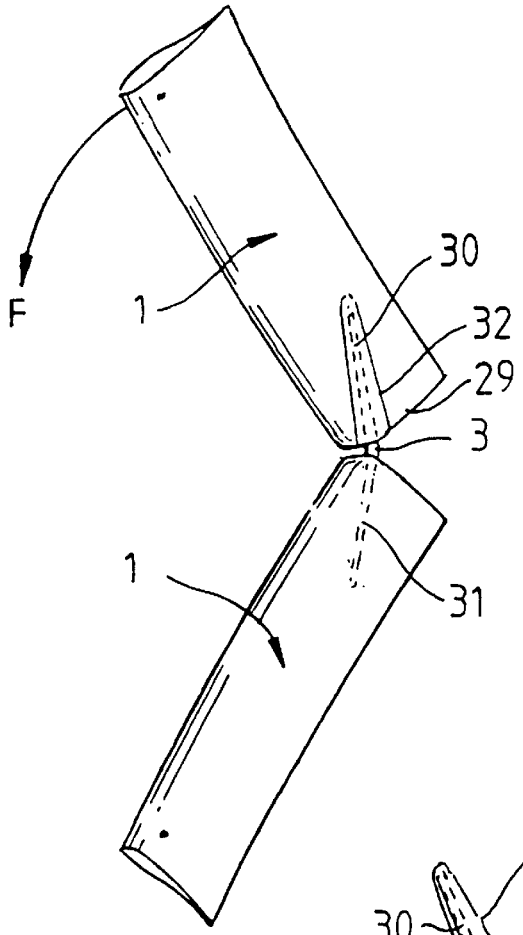
FIGS. 17, 18 and 19 are perspective illustrations of the same hydrofoil apparatus as that in FIG. 16, but with the same bridle adjustment as that in FIGS. 5 and 6, and illustrate three stages in the folding together of the first and second hydrofoil members.
Figure 18:
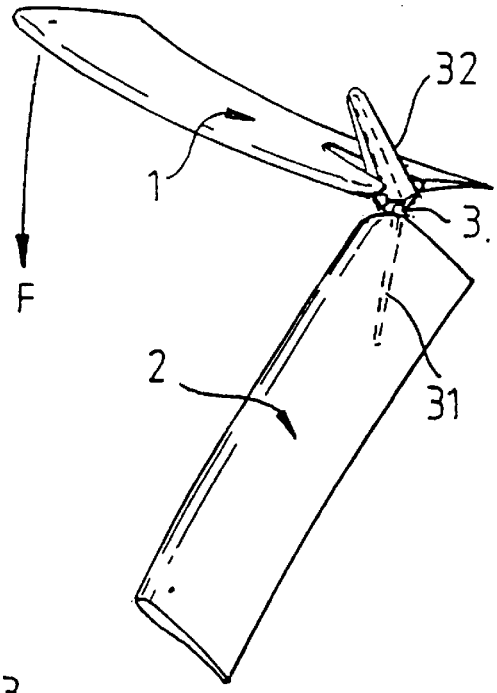
Figure 19:
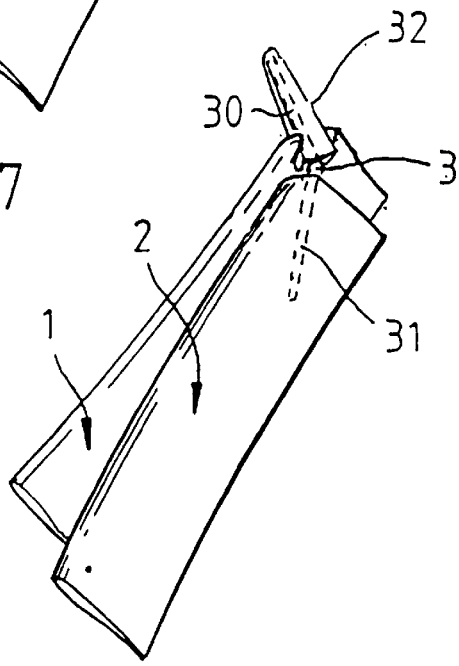

FIGS. 17,18 and 19 are three perspective illustrations which are the same as those in FIGS. 13,14 and 15 and with the same bridle adjustments but the hydrofoil apparatus includes the same connection means as that shown in FIG. 16. The intermediate connection member 32, which turns about the fist connection shaft 30, is articulately connected to the inner end portion 29 of the hydrofoil member 1, such that the hydrofoil member 1 is able to fold round, as indicated by the arrows F, to lie with its suction surface facing that of hydrofoil member 2, as shown in FIG. 19, but when being unfolded, the intermediate connection member 32 is guided back to its correct location on the hydrofoil member 1 for normal operation, as shown in FIG. 17.

Figure 20:
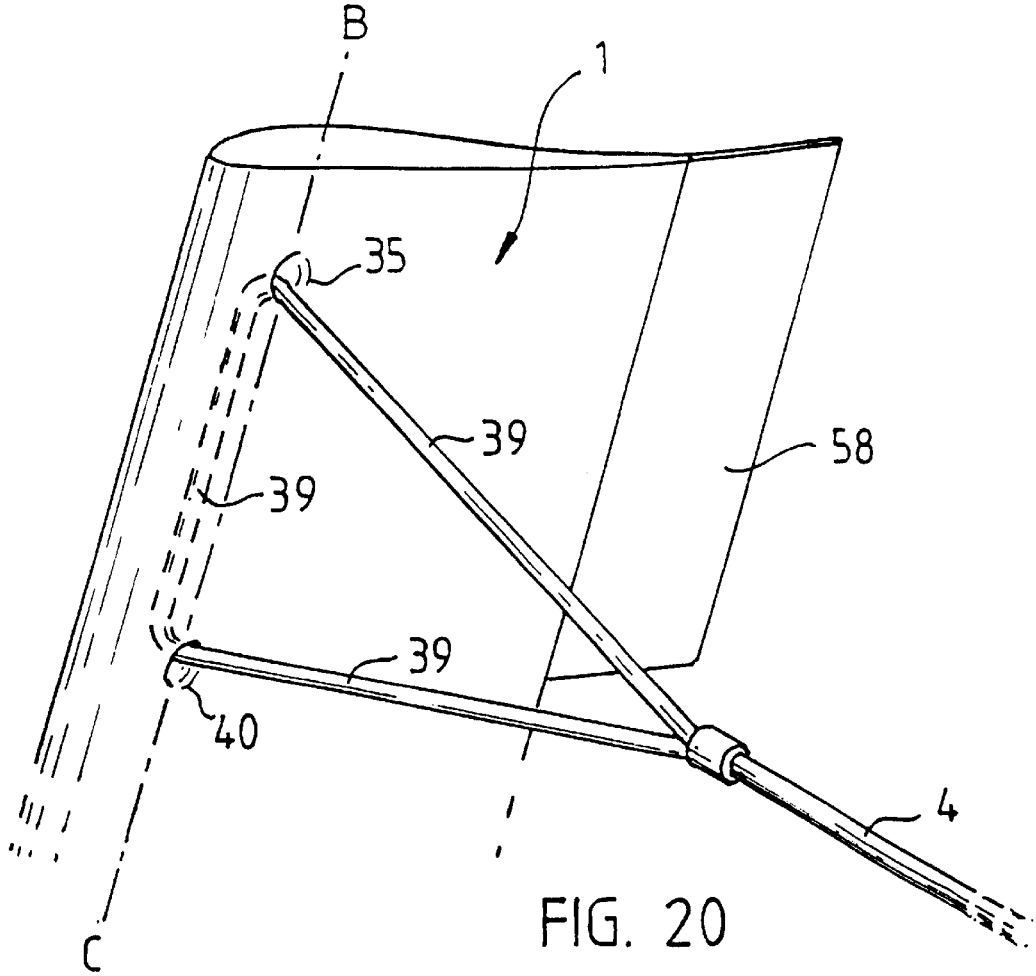
FIG. 20 is a perspective illustration of the outer end portion of a hydrofoil member and its bridle attachment, which is arranged to transmit control.

FIG. 20 is a perspective view of another example of bridle attachment whereby secondary control functions may accompany a bridle adjustment. Bridle member 4 is attached to the outer portion of hydrofoil member 1 through being formed into an eye 39 through two fairleads 35,40 on the hydrofoil member 1 at locations that are displaced from each other but which also lie on or very close to the pitching axis BC such that when the hydrofoil member 1 pitches, there is only such movement of the eye 39 through the fairleads 35,40 that is desirable. Bridle member length adjustments that alter the angle formed by the bridle member 4 and the pitching axis BC cause movement of the eye 39 between the fairleads 35,40 which acts, through a control mechanism (not shown), to provide secondary control functions which may include varying the strength of the opposition means and or changing the pitching moments and or lift and drag characteristics of the hydrofoil member 1.

Figure 21:
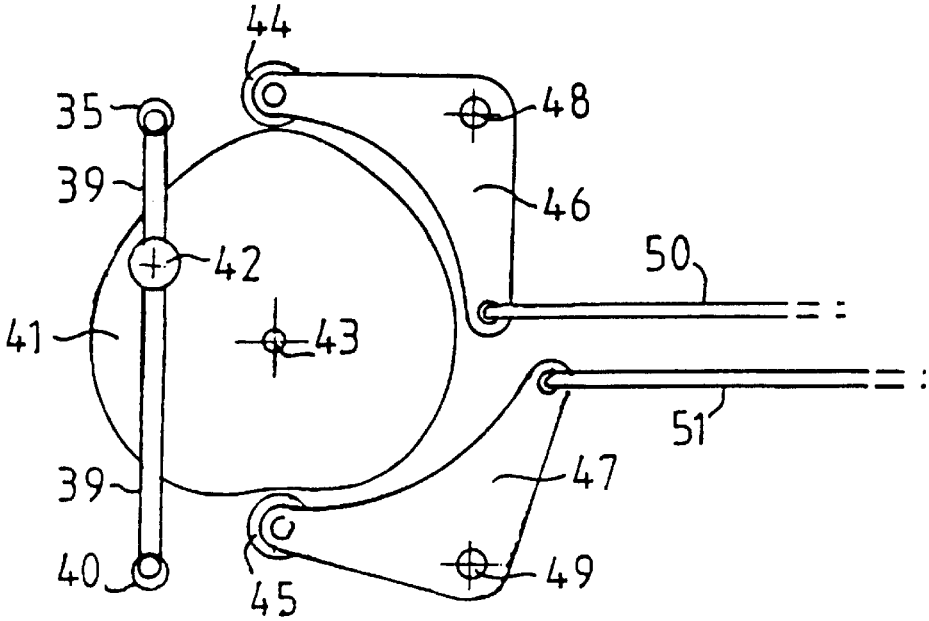
FIG. 21 is a schematic diagram of a secondary control modulating mechanism.

FIG. 21 is a schematic diagram of an example of a secondary control modulating mechanism that may be used to provide a modulation means. A portion of the bridle member eye 39 is shown between the first and second fairleads 35,40 and is attached to the cam 41 at the point 42 such that movement of the bridle eye 39 between the fairleads 35,40 turns the cam 41 about the axis 43. Cam followers 44,45 work the rockers 46,47 about their axes 48,49 to transmit the modulated control action to the control members 50,51, respectively, which carry the modulated secondary control action on to modify the hydrofoil member characteristics in the desired way.

Figure 22:
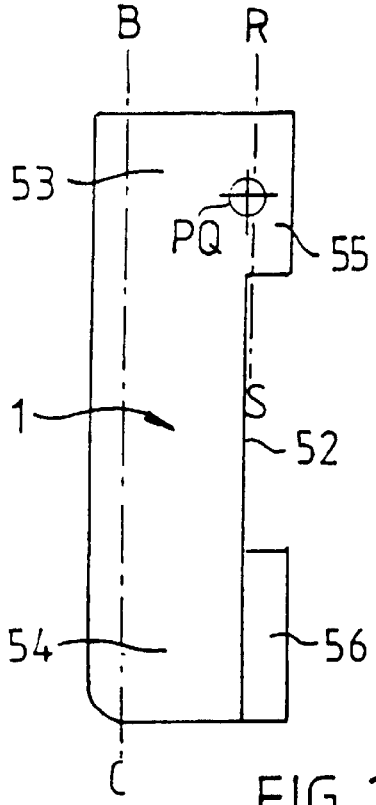
FIGS. 22 and 23 are schematic illustrations of a hydrofoil member which in this example, has separate pitch and drag controlling hydrofoil surfaces on each of its end portions, and is viewed from its pressure side and also from behind.

FIG. 22 is a schematic illustration of an example of a hydrofoil member, when seen from its pressure side, and on which both the outer end portion 53 and the inner end portion 54 include a separate hydrofoil surface 55,56 respectively, which is orientated with respect to the pitching axis BC such that when either end portion is trailing due to sweep, the hydrodynamic pitching moments of that portion are higher than when it is leading. At least one of the separate hydrofoil surfaces 55,56 is orientated to give the hydrofoil member 1 positive hydrodynamic pitching moments, when it has no sweep. In addition, at least one of the hydrofoil surfaces 55,56 may be free to feather to its apparent water flow when its end portion is leading. The axes PQ,RS are two separate examples of feathering axes about which the separate hydrofoil surface 55 may be permitted a degree of freedom to feather to its apparent water flow and which, on reaching the limits of this freedom, may become active in contributing to the hydrodynamic pitching moment characteristics of the hydrofoil member 1. This freedom to feather may be such that when the end portion 53 is leading it is inactive but when trailing it becomes active. At least one of the hydrofoil surfaces 55,56 may also be controllable.

Figure 23:
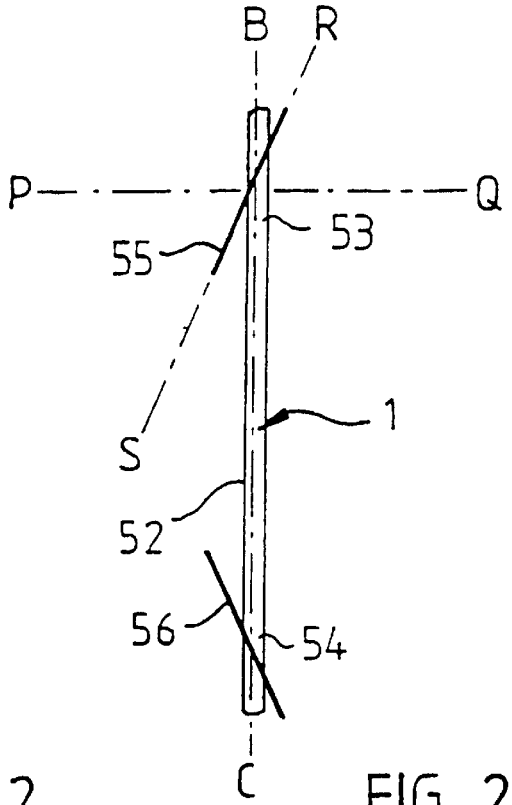

FIG. 23 is a schematic illustration of the same hydrofoil member as that in FIG. 22 but when seen from behind.

Figure 24:
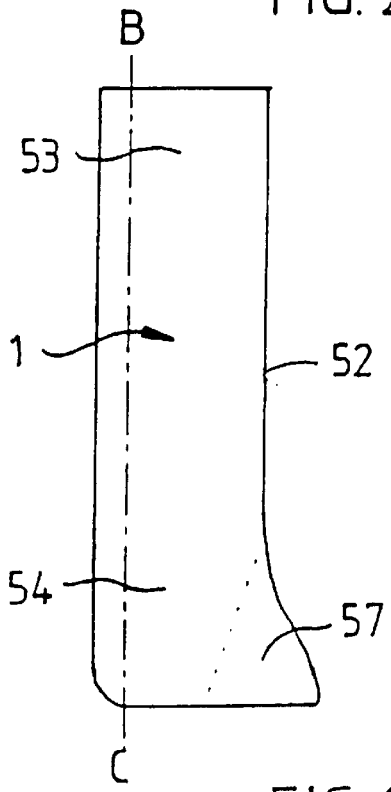
FIGS. 24 and 25 schematic illustrations of another hydrofoil member which, in this example, has chord and part chord hydrofoil surfaces which are pitch and drag controlling and is shown in the same views as those in FIGS. 22 and 23.

FIG. 24 is a schematic illustration of another example of a hydrofoil member, when seen from its pressure side and shows an outer end full chord portion 53 that is twisted (in the form of wash-out) to have increased pitching moments when trailing due to sweep and an inner end portion 54 which includes only trailing chord portion 57 that is orientated, with respect to the pitching axis BC, to give increased hydrodynamic pitching moments, when the inner end portion 54 is trailing due to sweep.

Figure 25:
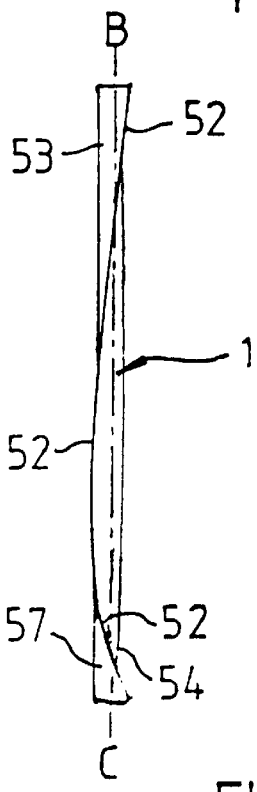

FIG. 25 is a schematic illustration of the same hydrofoil member as that in FIG. 24, but when seen from behind.

Figure 26:
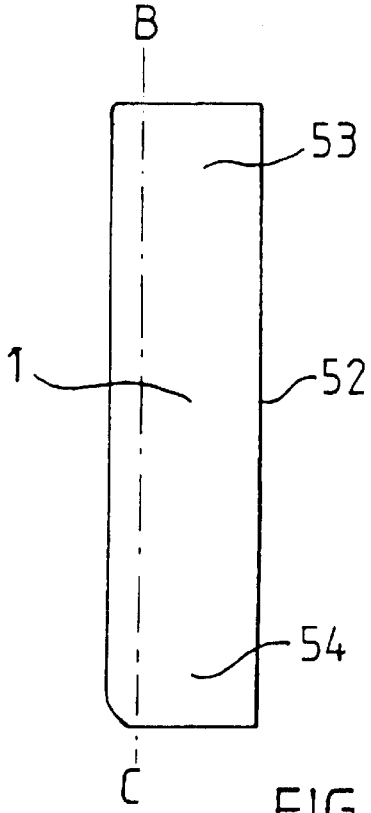
FIGS. 26 and 27 schematic illustrations of another hydrofoil member which, in this example, has considerable twist, in the form of wash-out, and is shown in the same views as those in FIGS. 22 and 23.

FIG. 26 is a schematic illustration of another example of a hydrofoil member when seen from its pressure side and which has considerable twist (in the form of wash-out) such that when the outer end portion 53 is operating at a comparatively high lift to drag ratio, the inner end portion 54 is operating at a very high angle of incidence which gives high lift but also very high drag.

Figure 27:
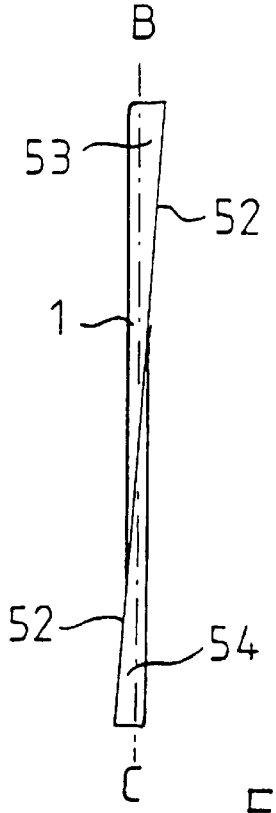

FIG. 27 is a schematic illustration of the same hydrofoil member as that in FIG. 26, but seen from behind.

Figure 28:
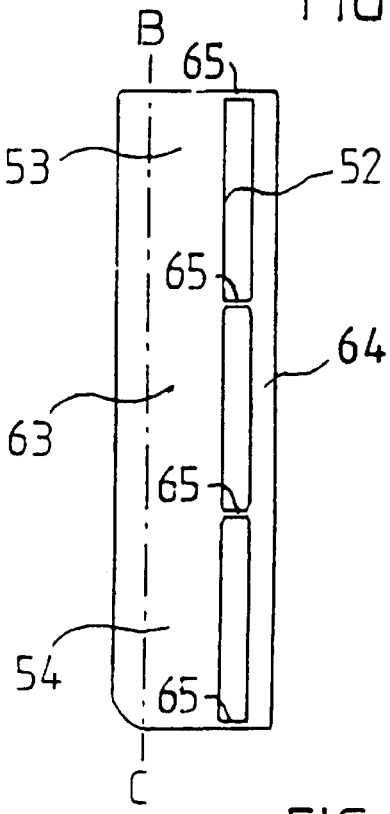
FIGS. 28 and 29 are schematic illustrations of yet another hydrofoil member which, in this example, has considerable twist, in the form of wash-out, as well as a second hydrofoil surface and is shown in the same views as those in FIGS. 22 and 23.
Figure 29:
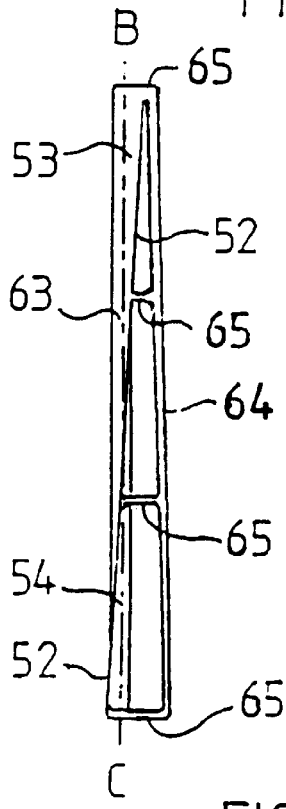

FIGS. 28 and 29 arc schematic illustrations of yet another example of a hydrofoil member which comprises a main hydrofoil surface 63 which is seen from its pressure side, and which has considerable twist (in the form of wash-out) having a trailing edge 52, and a second hydrofoil surface 64 which is seen from its suction side and which is joined to the main hydrofoil surface 63 by the short connecting arms 65. The hydrofoil member derives its positive pitching moments, at least in part, by the action of its second hydrofoil surface 64. The characteristic distributions of area and/or twist and or cross-section, over the span of the second hydrofoil member 64, are such as to cause, or contribute to, an increase in the angle of incidence that the hydrofoil member seeks to adopt, as it becomes more completely immersed towards its outer end 53. Also, the orientation of the second hydrofoil member 64, with respect to the pitching axis BC, is shown such that the positive pitching moment contribution it makes is greater when the hydrofoil member has forward sweep (i.e. with its outer portion 53 leading and its inner portion 54 trailing) than when it has backwards sweep of a comparable degree.

Figure 30:
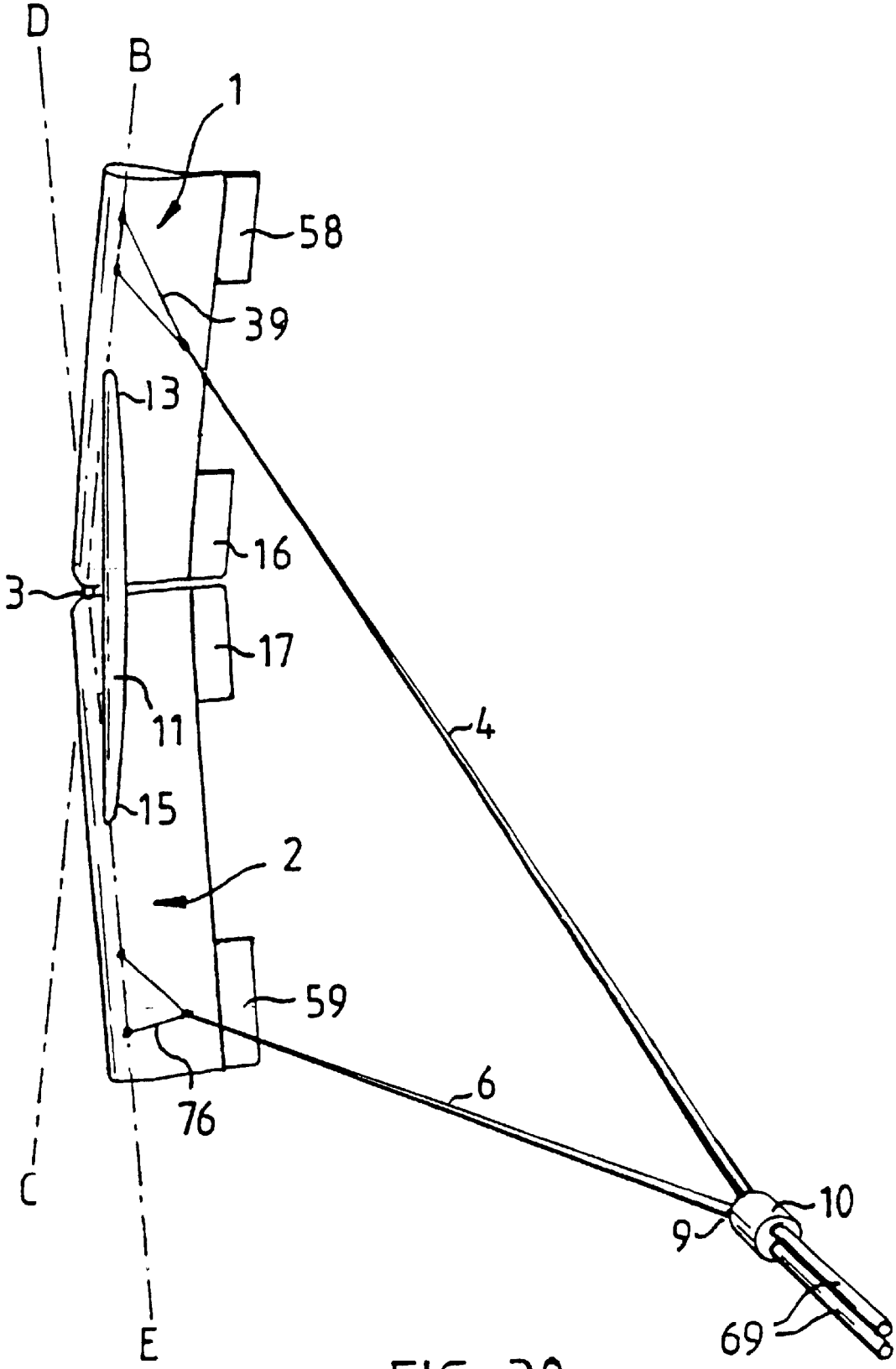
FIG. 30 is a perspective illustration of a hydrofoil apparatus constituting another embodiment of the present invention that is viewed from the same position as that in FIG. 1.

FIG. 30 is a perspective illustration of a further embodiment of the invention that is similar to those of FIGS. 1 and 16 but which has only two bridle members 4,6 the angle regulation means being instead provided solely by the strut 11, which is articulately attached to the hydrofoil members 1,2 at the attachment locations 13,15 which are positioned substantially on the pitching axes BC,DE respectively. The first and second hydrofoil members 1,2 are shown with first and second bridle member eyes 39,76 and third and fourth control surfaces 58,59 respectively.

Figure 31:
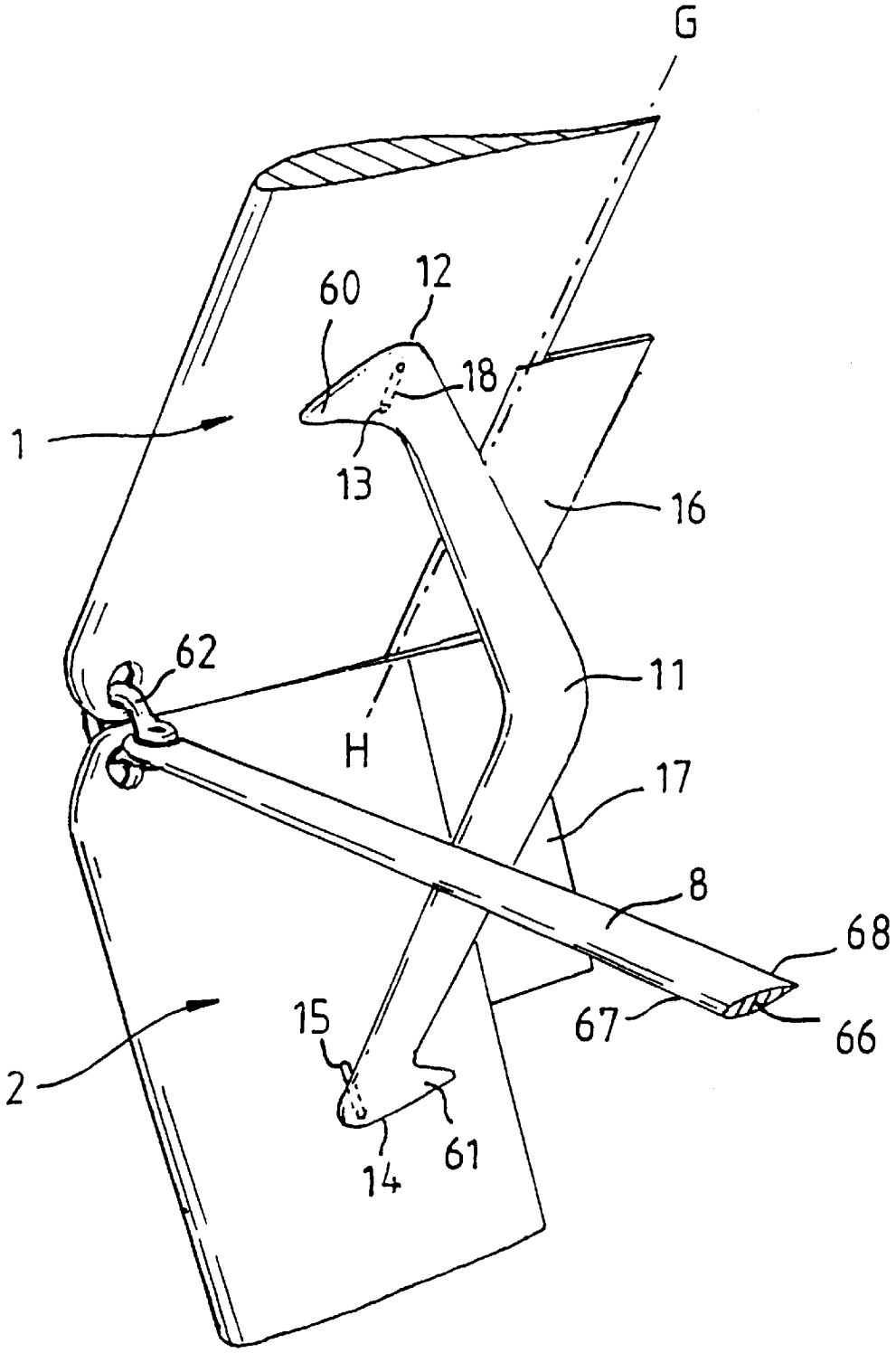
FIG. 31 is a perspective illustration of the middle portion of a hydrofoil apparatus that is viewed from the same position as, and is similar to, that in FIG. 1 and which shows strut attachment end protruberances and a loose but captive link connecting member, with attached bridle member.

FIG. 31 is a perspective illustration of the middle portion of a hydrofoil apparatus that is viewed from the same position as that in FIG. 1. Protruberances 60,61 are shown reaching forwards and backwards, from the strut attachment ends 12,14, respectively. When the first hydrofoil member 1 pitches leading edge down, or the second hydrofoil member 2 pitches leading edge up, with respect to the strut 11, a point is reached when at least one of the protruberances 60,61 comes to bear on its respective hydrofoil member at a point that is displaced some distance forwards or backwards from the strut attachment locations 13 or 15, respectively. Further pitching of this kind is thereby inhibited and ultimately prevented, providing pitching limitation means. The hydrofoil members 1,2 are shown connected to each other by the connection means that is provided by a loose but captive link 62 by which the third bridle member 8 is also articulately attached to the connection means by being held loosely captive. The bridle member 8 is of streamlined cross-section 66, having a leading edge 67 and a trailing edge 68. The axis GH is a further example of a feathering axes about which a hydrofoil surface (hydrofoil surface 16) may be permitted a degree of freedom to feather to its apparent water flow and which, on reaching the limits of this freedom, may become active in contributing to the hydrodynamic pitching moment characteristics of a hydrofoil member (hydrofoil member 1).

It is to be appreciated that the embodiments of the invention described above, with reference to the drawings, have been given by way of example only, and that modifications may be effected. Thus, for example, the secondary control modulation mechanism shown in FIG. 21 may be of other designs. Also, the function of the bridle member eye 39 in FIG. 20 may be performed instead by an arm, one end of which is attached to the bridle member and the other end being articulately attached to the hydrofoil member in such a way as to impart the controlling axial movements that are required, along the pitching axis.

I claim:

1. Hydrofoil apparatus comprising a first hydrofoil member having chord and span dimensions and positive hydrodynamic pitching moments, a second hydrofoil member having chord and span dimensions and positive hydrodynamic pitching moments, connection means for connecting the first and second hydrofoil members together such that they are able to articulate about the connection means, at least first and second bridle members which are for enabling the hydrofoil apparatus to be towed and are such that the first bridle member is articulately attached at one end to an outer end portion of the first hydrofoil member thereby forming a first pitching axis, the second bridle member is articulately attached at one end to an outer end portion of the second hydrofoil member thereby forming a second pitching axis, the first and second pitching axes forming an angle such that a component of hydrodynamic lift generated by the first hydrofoil member and a component of hydrodynamic lift generated by the second hydrofoil member act in parallel directions away from each other, and regulation means by which the angle formed by the first and second pitching axes is regulated.

2. Hydrofoil apparatus according to claim 1 and including a third bridle member which is articulately attached at one end to the connection means or to the inner end portions of the first and second hydrofoil members at locations that lie substantially on their respective pitching axes.

3. Hydrofoil apparatus according to claim 1 and including opposition means for enabling the first and second hydrofoil member pitching moments to act in opposition to each other.

4. Hydrofoil apparatus according to claim 1 in which the connection means includes at least one loose but captive link.

5. Hydrofoil apparatus according to claim 1 in which the connection means includes at least one flexible connecting member of low torsional resistance.

6. Hydrofoil apparatus according to claim 1 in which the connection means is provided with at least a first connection axis about which at least one of the first and second hydrofoil members has at least some freedom to turn.

7. Hydrofoil apparatus according to claim 1 in which the regulated angle formed by the first and second pitching axes, and which lies to the pressure sides of the first and second hydrofoil members, is regulated such that it is free to increase above a certain regulated minimum.

8. Hydrofoil apparatus according to claim 3 in which the connection means is provided with at least a first connection axis about which at least one of the first and second hydrofoil members has at least some freedom to turn, the opposition means and the connection means are both provided when a first connection axis on which the first hydrofoil member turns and a second connection axis on which the second hydrofoil member turns are arranged such that they diverge backwards from the first and the second pitching axes, on moving towards the outer ends of their respective hydrofoil members.

9. Hydrofoil apparatus according to claim 8 in which the strength of opposition is controllable in at least one of the following ways:

(i) the angle formed between the first and second connection axes is controllable; and (ii) the angle formed by at least one of the first and second connection axes and the pitching axis of its respective hydrofoil member is controllable.

10. Hydrofoil apparatus according to claim 6 in which the connection means includes at least a first intermediate connecting member which turns about the first and/or second connection axis, and which is also articulately connected to its respective hydrofoil member such that the angle formed by the first and second pitching axes, and which lies to the pressure sides of the first and second hydrofoil members, is free to increase above a certain regulated minimum.

11. Hydrofoil apparatus according to claim 1 and including at least one strut and attachmentmeans, and in which a first end of the strut is articulately attached to the first hydrofoil member at a location that is displaced from the connection means, and a second end is articulately attached to the second hydrofoil member at a location that is displaced from the connection means.

12. Hydrofoil apparatus according to claim 11 and including at least a first attachment member by which the first and/or second strut end is attached to the first and/or second hydrofoil member respectively.

13. Hydrofoil apparatus according to claim 11 and including the opposition means of claim 3 in which the opposition means is provided by a strut having a first end which is articulately attached to the first hydrofoil member at a location that is behind the first pitching axis, and a second end that is articulately attached to the second hydrofoil member at a location that is behind the second pitching axis.

14. Hydrofoil apparatus according to claim 11 in which the attachment means includes at least a first intermediate attachment member to which at least one of the first and second ends of the strut is articulately attached and which is also articulated with its respective hydrofoil member such that the angle formed by the first and second pitching axes, and which lies to the pressure sides of the first and second hydrofoil members, is free to increase above a certain regulated minimum.

15. Hydrofoil apparatus according to claim 11 in which the at least one strut and its attachments are characterised in at least one of the following ways:

(i) at least one attached strut end is free to move in a generally span-wise direction away from the outer end of its respective hydrofoil member, but is moved to an outer span-wise limit by the strut, when it comes under compression; and (ii) the distance between the first and second attached ends of the strut is free to increase above a minimum.

16. Hydrofoil apparatus according to claim 13 in which the strength of opposition is controllable in at least one of the following ways:

(i) the location of the attachment of the first and/or second strut end on at least one of the first and second hydrofoil members is controllable; and (ii) the distance between the first and second attached ends of the strut is controllable.

17. Hydrofoil apparatus according to claim 1 and including moment variation means for controlling the hydrodynamic pitching moment characteristics of at least one of the first and second hydrofoil members.

18. Hydrofoil apparatus according to claim 1 and in which the pitching moment characteristics of at least one of the first and second hydrofoil members are such that it seeks to increase its angle of incidence as more of its span becomes immersed towards its outer tip.

19. Hydrofoil apparatus according to claim 1 and in which at least one of the first and second hydrofoil members includes at least one separate or part chord hydrofoil surface whose orientation, with respect to the hydrofoil member's pitching axis, is such that it seeks to increase the hydrofoil member's pitching moments more when it is swept forwards than when it is swept backwards by the same angle.

20. Hydrofoil apparatus according to claim 1 and in which at least one of the first and second hydrofoil members includes at least one separate or part chord hydrofoil surface which is articulately attached to its main hydrofoil surface with a certain freedom to feather to its apparent water flow and which, on reaching the limits of this freedom, may acquire an angle of incidence, with respect to its apparent water flow, causing it then to contribute to the hydrofoil member's pitching moment characteristics.

21. Hydrofoil apparatus according to claim 6 in which the opposition means and the connection means are both provided when a first connection axis on which the first hydrofoil member turns and a second connection axis on which the second hydrofoil member turns are arranged such that they diverge backwards from the first and the second pitching axes on moving towards the outer ends of their respective hydrofoil members.

22. Hydrofoil apparatus according to claim 1 in which adjustments to the length of at least one of the bridle members forms control means for effecting at least one of the following control functions:

(i) controlling the first and second hydrofoil members such that the angle formed by the first and second pitching axes is able to be varied, so forming part of the regulation means;

(ii) controlling the relative distances of the outer ends of the first and second hydrofoil members from a towing point;

(iii) controlling at least one of the first and second hydrofoil members such that it experiences a change in its hydrodynamic pitching moment characteristics, consequent upon a change in the angles formed by at least one of the first and second pitching axes and bridle members;

(iv) controlling at least one of the first and second hydrofoil members such that it experiences a change in its drag characteristics, consequent upon a change in the angles formed by at least one of the first and second pitching axes and the bridle members;

(v) controlling the location of the strut attachment on at least one of the first and second hydrofoil members consequent upon a change in the angles formed by at least one of the first and second pitching axes and the bridle members; and (vi) controlling the angle formed by at least one of the first and second connection axes and the pitching axes of their respective hydrofoil members, consequent upon a change in the angles formed by at least one of the first and second pitching axes and the bridle members.

* * * * *